US012275556B2

(12) United States Patent
Lopez Uran et al.

(10) Patent No.: US 12,275,556 B2
(45) Date of Patent: Apr. 15, 2025

(54) PALLET WITH AT LEAST ONE DEVICE CHAMBER

(71) Applicant: CHEP Technology Pty Limited, Sydney (AU)

(72) Inventors: Daniel Lopez Uran, Addlestone Surrey (GB); Malcolm Charles Cant, Addlestone Surrey (GB); Jan Vinke, Roswinkel (NL); Torsten Podhajecky, Minden (DE)

(73) Assignees: CHEP Technology Pty Ltd, Sydney (AU); CHEP UK Ltd, Surrey (GB)

( * ) Notice: Subject to any disclaimer, the term of this patent is extended or adjusted under 35 U.S.C. 154(b) by 0 days.

(21) Appl. No.: 17/755,680

(22) PCT Filed: Nov. 6, 2019

(86) PCT No.: PCT/EP2019/080443

§ 371 (c)(1),
(2) Date: May 5, 2022

(87) PCT Pub. No.: WO2021/089142

PCT Pub. Date: May 14, 2021

(65) Prior Publication Data

US 2022/0380088 A1 Dec. 1, 2022

(51) Int. Cl.
*B65D 19/38* (2006.01)
*B65D 19/00* (2006.01)

(52) U.S. Cl.
CPC ..... *B65D 19/38* (2013.01); *B65D 19/0026* (2013.01); *B65D 2519/00034* (2013.01);
(Continued)

(58) Field of Classification Search
CPC ..... B65D 19/38; B65D 2519/00034; B65D 2519/00069; B65D 2519/008
(Continued)

(56) References Cited

U.S. PATENT DOCUMENTS 6,943,678 B2 * 9/2005 Muirhead ..... B29C 51/12 340/572.8
2005/0237184 A1 * 10/2005 Muirhead ..... B29C 66/54 108/57.25

(Continued)

FOREIGN PATENT DOCUMENTS

JP H0811885 1/1996
JP 2008050024 * 3/2008

(Continued)

OTHER PUBLICATIONS

International Search Report and Written Opinion for International Application No. PCT//EP2019/080443, dated Aug. 11, 2020, (15 pages), European Patent Office, Rijswijk, Netherlands.

(Continued)

*Primary Examiner* — Jose V Chen
(74) *Attorney, Agent, or Firm* — Alston & Bird LLP

(57) ABSTRACT

There is disclosed a pallet component comprising a support portion and an attachment portion. The attachment portion extends from the support portion and is defined, at least in part, by a perimeter wall. The perimeter wall surrounds one or more internal chambers. The attachment portion is configured to engage a corresponding attachment portion of another pallet component. The one or more internal chambers comprises at least one device chamber configured to at least partially receive an electronic device therein. One or more walls of the attachment portion comprises one or more cut-outs which define, at least in part, a fluid pathway between the at least one device chamber and atmosphere.

23 Claims, 15 Drawing Sheets

(52) U.S. Cl.
CPC ..... *B65D 2519/00069* (2013.01); *B65D 2519/00273* (2013.01); *B65D 2519/00288* (2013.01); *B65D 2519/00308* (2013.01); *B65D 2519/00323* (2013.01); *B65D 2519/00333* (2013.01); *B65D 2519/008* (2013.01)

(58) Field of Classification Search
USPC ..... 108/51.11–57.34
See application file for complete search history.

(56) References Cited

U.S. PATENT DOCUMENTS

| | | | | |
|---|---|---|---|---|
| 2008/0053342 | A1* | 3/2008 | Muirhead | B65D 19/0012 108/57.25 |
| 2010/0182150 | A1* | 7/2010 | Edelstain | G06K 19/07758 29/428 |
| 2015/0274359 | A1* | 10/2015 | Linares | B65D 19/0004 108/53.1 |
| 2016/0039566 | A1 | 2/2016 | Lorenz et al. | |
| 2019/0168912 | A1* | 6/2019 | de Bokx | B65D 19/44 |
| 2019/0235092 | A1* | 8/2019 | Bastian, II | G01G 19/52 |
| 2021/0009310 | A1* | 1/2021 | Moeller | G06K 19/07786 |
| 2021/0024301 | A1* | 1/2021 | Khambati | B65G 1/00 |
| 2021/0055152 | A1* | 2/2021 | Ekkel | G01G 19/52 |
| 2021/0188482 | A1* | 6/2021 | Meiring | B65D 19/38 |
| 2021/0331833 | A1* | 10/2021 | Ceré | B65D 19/38 |
| 2022/0029560 | A1* | 1/2022 | Green | H02N 2/186 |
| 2022/0177134 | A1* | 6/2022 | Landry | B65D 19/38 |

FOREIGN PATENT DOCUMENTS

| | | |
|---|---|---|
| JP | 2009 018829 | 1/2009 |
| JP | 2015224048 | 12/2015 |
| JP | 2019-011092 A | 1/2019 |
| JP | 2019-156445 A | 9/2019 |
| WO | WO-2013/120595 A1 | 8/2013 |

OTHER PUBLICATIONS

Japanese Office Action for Application No. 2022-525658, dated Aug. 8, 2023, (11 pages), Japan Patent Office.

* cited by examiner

PALLET WITH AT LEAST ONE DEVICE CHAMBER

RELATED APPLICATION

This application claims the benefit of PCT patent application no. PCT/EP2019/080443 filed Nov. 6, 2019, which is hereby incorporated herein in its entirety by reference.

The present invention relates to a pallet component, a pallet component assembly, a pallet and a pallet assembly.

Pallets for distributing products from one location to another, and for use as display-at-the-store pallets, are well known. Such pallets can be provided in a range of sizes such as, for example, full size pallets, half size pallets and quarter pallets. Examples of such pallets may comprise platforms with pallet supports, which can include feet, skids and wheels. Wheels may be incorporated in dollies, which may otherwise be referred to as wheeled pallets.

It is desirable to be able to incorporate digital technologies into pallets. However, in order to effectively incorporate such technologies, modifications to existing pallet designs are required.

There exists a need to overcome one or more of the disadvantages associated with existing pallets.

According to a first aspect of the invention there is provided a pallet component, the pallet component comprising:

a support portion; and an attachment portion extending from the support portion and defined, at least in part, by a perimeter wall, the perimeter wall surrounding one or more internal chambers, the attachment portion configured to engage a corresponding attachment portion of another pallet component;

wherein the one or more internal chambers comprises at least one device chamber configured to at least partially receive an electronic device therein; and wherein one or more walls of the attachment portion comprises one or more cut-outs which define, at least in part, a fluid pathway between the at least one device chamber and atmosphere.

The support portion may be integrally formed with the attachment portion. That is to say, the support portion and attachment portion may be formed as a single body. The attachment portion may be said to be connected to the support portion.

The perimeter wall may be a single wall or a plurality of walls. The perimeter wall may be said to extend from a surface of the support portion. Specifically, the perimeter wall may be said to extend from a base portion of the skid, or an underside of the deck. The perimeter wall may be said to be vertical, vertically extending, or substantially vertically extending. In other words, the perimeter walls may project away from the support portion. The perimeter wall, or walls, may extend beyond the one or more internal chambers. The attachment portion may be defined by the perimeter wall such that the perimeter wall defines an outermost wall of the attachment portion. Alternatively, the perimeter wall may define only part of the attachment portion i.e. such that other parts of the attachment portion may project beyond the perimeter wall. The perimeter wall may otherwise be described as a surrounding wall, or a peripheral wall. The above also equally applies to partition and/or device chamber walls. That is to say, generally a wall may be said to be vertically extending, or substantially vertically extending (e.g. may be tapered).

The one or more walls may comprise the perimeter wall. The one or more walls may comprise a device chamber wall. The one or more walls may comprise a partition wall. The one or more walls may comprise any combination of the perimeter wall(s) and/or device chamber wall(s) and/or partition wall(s). The one or more cut-outs may be defined in, or formed in, the perimeter wall. A plurality of cut-outs may be defined in, or formed in, the perimeter wall.

The internal chambers may otherwise be defined as cavities with an open face. The internal chambers may be cavities with one open face. The distribution of internal chambers may be substantially symmetrical. That is to say, the distribution may have at least one axis of symmetry within at least the attachment portion.

The attachment portion may be a block. The attachment portion may be for separating the support portion from the corresponding attachment portion of the different pallet component. Engagement may include abutment. The attachment portion may be a central attachment portion of a plurality of attachment portions. The centrality may be taken relative to one axis, or two axes. Alternatively, the attachment portion may not be a central attachment portion, and may instead be adjacent a central attachment portion (i.e. an outer 'block').

The cut-outs are intended to refer to regions which do not incorporate material. These may take the form of grooves, recesses, apertures or openings. The cut-outs may otherwise be described as ventilation holes (although it should be recognised that the ventilation holes are not necessarily surrounded by material i.e. they may be more akin to indentations, or grooves). In some instances, the cut-outs may be formed by material having been removed from the surrounding body. In other instances, the cut-outs may simply be regions in which material was never present (i.e. the cut-outs were present from the initial manufacture of the body). That is to say, cut-outs generally refer to an absence of material from a surface. One or more cut-outs in the perimeter wall may be referred to as perimeter wall cut-outs.

The cut-outs may specifically define a fluid pathway between the at least one device chamber and atmosphere in use. That is to say, even when the electronic device is received in the device chamber, the cut-outs may still define a fluid pathway i.e. the pathway is not blocked owing to the presence of the electronic device. In this sense the cut-outs are distinct from any orifice through which the electronic device is received (because the orifice does not define a fluid pathway in use).

The cut-outs may 'direct' external water jets towards particular walls. A central axis of the cut-out(s) may be aligned with a wall (such as a partition wall or device chamber wall). Aligned with in this context is intended to mean directed towards, or aimed at. More preferably, the central axis is offset from any (other) cut-outs. This may further reduce undesirable liquid leakage. This is particularly effective where the cut-outs are perimeter wall cut-outs.

The fluid pathway is intended to refer to a passageway which fluidly connects the at least one device chamber to the external atmosphere. The fluid pathway may otherwise be described as a passageway, or channel, for example an airflow channel. The fluid pathway may otherwise be referred to as an internal labyrinth. The atmosphere may be described as a region outside the pallet component, specifically external atmosphere or external location. The fluid pathway provides fluid communication between the at least one device chamber and atmosphere. The fluid pathway can be said to be formed of, or defined by, a network of cut-outs. In turn, the cut-outs define one or more channel(s). In preferred arrangements, the one or more cut-outs define a fluid pathway between the at least one device chamber and atmosphere. That is to say, the fluid pathway spans between the at least one device chamber and the atmosphere. The fluid pathway may be said to fluidly connect the at least one device chamber to the atmosphere.

An advantage provided by the fluid pathway is that a device, which may be received in the at least one device chamber, is able to sample conditions such as, for example, temperature and humidity. These conditions may be referred to as atmospheric variables, or environmental conditions. Furthermore, the device may be able to sample the aforementioned conditions whilst remaining protected from day-to-day use, and so wear, of the pallet, including processes such as jet-washing. Put another way, an airflow can reach the at least one device chamber from outside the attachment portion whilst, simultaneously, the at least one device chamber remains protected from the ingress of liquid.

The fluid pathway may define a tortuous path between the atmosphere and the at least one device chamber. The fluid pathway may be said to define a labyrinth arrangement. The tortuous path, or labyrinth arrangement, assists in reducing the risk of liquid, such as from a washing process, leaking into the device chamber. Such leakage may otherwise risk malfunction of the device. The device can be used to sample, record and transmit the aforementioned atmospheric variables, which is desirable during transportation, and storage, of goods or products which may be loaded on the pallet component.

For the purposes of the fluid pathway, fluid may mean either liquid or gas. However, it will be appreciated that the invention is particularly advantageous where gas is able to be reach the chamber(s) whilst liquid is prevented from entering the chamber(s). For the purposes of this document, water vapour (such as in the use of humidity sensing) is considered a gas.

The at least one device chamber partially, or completely, receives an electronic device therein. The pallet component may incorporate one, or two, or more, device chambers. Where a pallet component comprises a plurality of device chambers, only one of the chambers may, in use, receive an electronic device.

Any unused device chamber (i.e. a device chamber without an electronic device received therein) may be sealed with a cap. Said cap may substantially prevent the ingress of fluid and dust, to name two examples, into the device chamber, at least in one direction. The electronic device may incorporate an integrated, or built-in, cap, or lid, which defines an end face of the electronic device. The cap or lid provides at least the same functionality as the cap used to seal an unused device chamber (i.e. it substantially seals the device chamber). The cap, or lid, also protects the electronic device from goods or products placed on the product supporting surface. The electronic device may be configured to provide load sensing functionality.

The device chamber may be accessed from above. Where the pallet component is a platform, the device chamber may be accessed through the product supporting surface. Specifically, the device chamber may be accessed through an orifice in the product supporting surface.

The one or more device chambers may incorporate aligning ribs. Said ribs may extend substantially parallel to the perimeter wall. The aligning ribs may otherwise be described as projections. The aligning ribs may prevent excessive contact between the electronic device and walls of the device chamber. This may result in easier insertion of the electronic device. The aligning ribs may also serve to separate the electronic device from any surrounding walls. This may be desirable for reasons of improved impact protection, and a reduced risk of leakage of liquid which may run down the walls (and could otherwise damage the electronic device).

The device chamber may be substantially rectangular in cross-section. The device chamber may be generally cuboidal. The device chamber may be defined by four walls.

An electronic device should, in use, be protected from environmental elements such as heat, rain and dust.

In use, the fluid pathway may substantially isolate the electronic device from liquid, such as water, during pallet washing and normal operation.

The one or more internal chambers may comprise a plurality of internal chambers.

A plurality of internal chambers reduces the risk of external liquid leakage. A plurality of internal chambers also allows other chambers to interpose the atmosphere and the device chamber, creating a more tortuous path (and thereby further reducing the risk of undesirable liquid leakage through the fluid pathway). It will be appreciated that the one or more internal chambers comprising a plurality of chambers means that the one or more internal chambers comprises the at least one device chamber and at least one other internal chamber.

The one or more cut-outs may comprise a plurality of cut-outs, and wherein the plurality of cut-outs are in direct fluid communication with different internal chambers of the plurality of internal chambers.

Direct fluid communication may otherwise be described as in facing relations with i.e. fluid passing through the cut-out necessarily enters the chamber in question. A cut-out in direct fluid communication with two chambers may interpose the two chambers i.e. divide the two chambers.

The one or more internal chambers may be distributed about a central aperture.

The central aperture may provide an opening for receipt of, for example, a fastener to connect the pallet component to the other pallet component. Distributing the one or more internal chambers about the central aperture may be desirable for reasons of easier manufacturing, owing to more balanced cooling of the pallet component when an injection moulding process is used.

The one or more cut-outs may define recesses in an end face of the perimeter wall, wherein the end face opposes the support portion.

The cut-outs being recesses may be simpler to manufacture. That is to say, because the geometry is a recess, the cut-out may be formed during manufacture of the pallet component. Said manufacture may be by way of injection moulding.

The end face may otherwise be described as a partition face. This is due to the fact that, in use, the end face abuts a corresponding end face in an adjacent pallet component. In other words, the end faces define a partition between the two components. The end face may be said to define a partition line between the two attachment portions in use.

The cut-outs may be semi-circular. Alternatively, the cut-outs may be rectangular, or substantially rectangular.

The pallet component may be a platform, the support portion may be a deck of the platform, the deck may comprise a product supporting surface for supporting goods thereon; and the attachment portion may be configured to engage a corresponding attachment portion of a skid.

The combination of a platform and one or more skids may form a pallet. The pallet may be a half pallet, quarter pallet or other size fractional pallet.

The pallet component may be a skid, the support portion may be for supporting the skid on a surface, and the attachment portion may be configured to engage a corresponding attachment portion of a platform.

The skid may be elongate. A plurality of skids may be attached to a platform, preferably three skids. The platform may be a pallet deck.

The at least one device chamber may comprise one or more cut-outs in a wall, or a base, thereof.

The base extends substantially horizontally. The walls may extend from the base. The one or more cut-outs in the wall or base of the device chamber may be referred to as device chamber cut-outs. The device chamber cut-out may provide fluid communication between the device chamber and the atmosphere. This is advantageous for reasons explained above regarding being able to sample environmental conditions, such as temperature and humidity, using the device.

The base may otherwise be referred to as an end face. Where appropriate, the orifice in the product supporting surface may be disposed opposite the end face of the device chamber. The walls of the device chamber may be referred to as device chamber walls. The at least one device chamber may comprise one or more cut-outs in a wall and/or a base thereof.

The at least one device chamber may comprise a plurality of cut-outs in a wall thereof.

The plurality of cut-outs may form an array, or arrangement, of cut-outs.

The perimeter wall may comprise a plurality of cut-outs, and the at least one device chamber may be in fluid communication with at least two different perimeter wall cut-outs of the plurality of cut-outs.

The at least one device chamber being in fluid communication with at least two different perimeter wall cut-outs is beneficial because a plurality of fluid pathways are defined. This can negate issues associated with having a single fluid pathway. Said issues include the risk that the single perimeter wall cut-out become blocked, or that the conditions detected are not representative of the surroundings. For example, if one region of the pallet component was located near an air vent, or heater, sampling via a single perimeter wall cut-out may provide incorrect results of, for example, temperature and humidity (when considered in the context of the general location the pallet component is in). The at least one device chamber being in fluid communication with at least two different perimeter wall cut-outs is therefore desirable because the conditions detected by an electronic device, received in the device chamber, are more representative and therefore more reliable.

One or more intermediate cut-outs, disposed in a partition wall, may interpose the one or more device chamber cut-outs and a most proximate one or more perimeter wall cut-outs.

Most proximate means nearest, i.e. least distance to, the one or more perimeter wall cut-outs (from the one or more device chamber cut-outs). The partition wall may define, at least in part, the one or more device chambers. The partition wall may be disposed between the perimeter wall and a device chamber wall.

The one or more intermediate cut-outs contribute to the tortuous path formed between the perimeter wall and the device chamber. This is advantageous because any electronic device remains protected from external impacts and/or liquid leakage whilst still being able to sample conditions such as temperature and/or humidity.

The partition wall may project beyond the perimeter wall. Alternatively, the perimeter wall may project beyond the partition wall. The partition wall may form part of a partition wall array. The partition wall array may comprise a plurality of partition walls. The intermediate cut-out may otherwise be referred to as a partition wall cut-out.

The one or more perimeter wall cut-outs, the one or more intermediate cut-outs, and the one or more device chamber cut-outs may define an indirect fluid pathway.

Indirect fluid pathway may mean that the fluid pathway between the cut-outs is tortuous. In other words, the fluid pathway incorporates twists and turns between the device chamber and atmosphere. At its most basic, the fluid pathway is not straight i.e. a straight body, such as a rod, could not be inserted through all cut-outs to reach the device chamber from the atmosphere.

The advantage of the indirect fluid pathway is that the risk of liquid ingress is reduced. Specifically, when the pallet component is cleaned, which may be by way of a jet wash, or if liquid is spilled on the pallet component, the risk of the fluid reaching the device chamber, and so electronic device, is reduced.

One or more supporting ribs may project into the at least one device chamber, the one or more supporting ribs defining a ledge configured to limit an extent of insertion of the electronic device received in the at least one device chamber.

The one or more supporting ribs may incorporate one or more cut-outs. The one or more supporting ribs may be considered to be examples of partition walls. The one or more cut-outs may define recesses in an outer face of the supporting rib, wherein the outer face opposes the support portion. Where the at least one device chambers incorporates aligning ribs, the supporting rib may be disposed between two aligning ribs. That is to say, a combination of the supporting rib, with an aligning rib at either end, may form a continuous wall.

The perimeter wall may incorporate a chamfer along portions of the perimeter wall adjacent the at least one device chamber.

The chamfer may be referred to as a leakage reducing chamfer. The chamfer serves to reduce the risk of liquid leaking into the device chamber. The chamfer therefore creates a more tortuous path which liquid must traverse in order to reach the device chamber. The chamfer can be considered to be a form of seal. The chamfer may be described as a sealing chamfer.

The chamfer may be said to extend across device chamber portions of the perimeter wall. In other words, the chamfers may be present along parts of the perimeter wall which define the at least one device chamber. Where there are a plurality of device chambers, there may be a plurality of chamfers. The plurality of chamfers may oppose one another. This is because the plurality of chamfers may be disposed across from one another, on opposite sides of the perimeter wall.

According to a second aspect of the invention there is provided a pallet component assembly comprising:

- a pallet component according to the first aspect of the invention; and
- an electronic device;
- wherein the electronic device is at least partially received by the at least one device chamber.

Pallet component assembly is intended to mean a pallet component and at least one other component. The pallet component assembly may form part of a pallet.

The electronic device may be entirely received by the at least one device chamber. An end face of the electronic device may be flush with the support portion, or a portion thereof.

According to a third aspect of the invention there is provided a pallet comprising:

a platform as defined above; and a skid as defined above;

wherein the attachment portions of the platform and skid engage one another.

The pallet may be a half pallet, quarter pallet or other size fractional pallet.

The one or more cut-outs of the platform and the skid may define recesses in end faces of the respective perimeter walls of the attachment portions of the platform and the skid, the one or more cut-outs in the respective perimeter walls aligning with one another to define one or more apertures.

Where the cut-outs are semi-circular, the apertures defined by a combination of cut-outs may therefore be circular. Generally, two aligned cut-outs define one aperture.

Aligning cut-outs may also be provided in partition walls and/or device chamber walls.

According to a fourth aspect of the invention there is provided a pallet comprising:

a platform as defined above; and a skid;

wherein the skid comprises:

a support portion; and an attachment portion extending from the support portion and defined, at least in part, by a perimeter wall, the perimeter wall surrounding one or more internal chambers;

wherein the device chamber is configured to fully receive the electronic device therein; and wherein the attachment portions of the platform and skid engage one another.

The device chamber being configured to fully receive the electronic device is intended to mean that the electronic device fits into the device chamber. Preferably only an end face of the electronic device is visible when the device is received in the device chamber.

Optionally there is provided a pallet assembly, comprising the pallet and an electronic device, wherein the electronic device is fully received by the device chamber.

The electronic device may otherwise be said to be received in the device chamber.

The device chamber may be defined by a plurality of walls and a base, and wherein the base comprises a cut-out which defines, at least in part, a fluid pathway between the device chamber and the atmosphere.

The cut-out in the base of the device chamber may be the only cut-out in the device chamber. It will be appreciated that an orifice may be present, through which the electronic device is inserted into the device chamber. However, given that the orifice is substantially sealed in use, by the electronic device, the orifice does not provide the fluid pathway functionality which the cut-outs do.

The base may otherwise be referred to as an end wall.

According to a fifth aspect of the invention there is provided a pallet assembly comprising:

a pallet comprising a deck, the deck comprising a product supporting surface, the product supporting surface comprising an orifice which defines an open face of a device chamber, the device chamber configured to receive an electronic device therein; and an electronic device configured to provide load sensing functionality;

wherein the electronic device is received in the device chamber and an end face of the electronic device is flush with the product supporting surface.

The end face of the electronic device may be referred to as an upper surface. The end face may be part of a lid or cap.

Substantially flush is intended to mean that any product placed upon the product supporting surface will also rest upon the end face of the electronic device.

According to a sixth aspect of the invention there is provided a pallet component, the pallet component comprising:

a surface in which an aperture is provided; and a plurality of walls which extend across the surface to define a plurality of internal chambers, wherein the plurality of walls comprises a dividing wall which defines, at least in part, at least two adjacent internal chambers of the plurality of internal chambers;

wherein the dividing wall intersects the aperture such that the at least two adjacent internal chambers are in communication with the aperture; and wherein the plurality of internal chambers comprises at least one device chamber configured to at least partially receive an electronic device therein.

The surface may be a flat surface. The surface may oppose a base. The surface may be an opposing side of an end face.

The aperture may otherwise be described as a hole or a bore. The aperture may be circular or polygonal (such as hexagonal or octagonal, or a fraction thereof). The aperture may be one of one or more apertures (i.e. the aperture need not be the only aperture disposed in the surface). The aperture may be said to be provided through a thickened surface (i.e. pass through a surface which has a thickness). The aperture may otherwise be described as a drainage hole.

The plurality of walls may be, or include, a plurality of ribs. The plurality of walls may comprise a perimeter wall and/or device chamber wall(s) and/or partition wall(s). The plurality of walls may extend from the surface. Alternatively, the plurality of walls may extend across the surface without contacting the surface (i.e. in the form of suspended walls, with a gap interposing the wall and the surface). The plurality of walls may extend across an entirety of the surface, or just a portion thereof.

The internal chambers may otherwise be defined as cavities with an open face. The internal chambers may be cavities with one open face. The surface may define one of the (closed) faces of the internal chambers, or cavities.

Intersects is intended to mean divides, or crosses. If the dividing wall intersects the aperture, the dividing wall will be visible from the other side of the aperture (i.e. the side opposite that across which the walls extend). The dividing wall need not pass through the aperture. In other words, the dividing wall need not span from an internal surface of the aperture to another internal surface of the aperture. Instead, the dividing wall may be disposed adjacent the aperture such that the dividing wall lies out of the plane of the aperture. With that said, the dividing wall may be disposed at least partly within the aperture such that the aperture is, in effect, divided into a plurality of apertures (and may therefore be said to be penetrated by the dividing wall). For example, where the overall aperture geometry is a circle, the dividing wall may divide the overall aperture into two semi-circles. All that is meant by the intersection is that the dividing wall enables the at least two adjacent internal chambers to communicate with a common aperture.

Communication with the aperture is intended to mean, at least, that a liquid in the internal chamber could flow through the aperture so as to exit the chamber. In other words, the aperture provides a drainage functionality. The at least two adjacent internal chambers can therefore be said to be in fluid communication with the aperture.

Advantageously, the at least two adjacent internal chambers being in communication with the aperture allows any liquid in either, or both, of the chambers to drain out through the single aperture. This is beneficial because, during washing processes, the pallet component is subjected to water jets and there is a risk that liquid be undesirably retained within the pallet component (specifically the internal chambers thereof). By having the aperture communicate with the at least two adjacent internal chambers, the number of apertures required to provide drainage for an array of internal chambers is reduced. This is desirable because increasing the number of apertures may reduce the overall robustness of the pallet component, and result in increased manufacturing cost.

The dividing wall may extend into the aperture.

Extending into the aperture is intended to mean extends into a depth of the aperture. That is to say, the dividing wall may penetrate the aperture to at least some extent. Alternatively, the dividing wall may not penetrate the aperture and may instead be disposed adjacent the aperture (i.e. out of the plane of the aperture).

The pallet component may further comprise:

a second aperture provided in the surface; and a second plurality of walls which extend across the surface to define a second plurality of internal chambers, wherein the second plurality of walls comprises a second dividing wall which defines, at least in part, at least two adjacent internal chambers of the second plurality of internal chambers;

wherein the second dividing wall intersects the second aperture such that the at least two adjacent internal chambers, defined at least in part by the second dividing wall, are in communication with the second aperture.

Put another way, if the intersected aperture is referred to as a first arrangement, the pallet or pallet component may further comprise a second arrangement (i.e. a second intersected aperture). The second arrangement may be identical to the first, or may be different. The aperture may be distributed in an array. For example, the apertures may be disposed at vertices of a rectangle about the surface.

Advantageously, by providing a number of intersected apertures drainage can be provided for, or to, a greater number of internal chambers.

According to a seventh aspect of the invention there is provided a pallet having an upper deck which forms a loading surface for goods;

a number of feet or skids which are arranged on the underside of the upper deck and which are preferably adapted for transporting by means of forklift trucks; and at least one receptacle for a built-in electronic component, characterized in that the at least one receptacle is formed in the upper deck in the manner of a blind hole or pocket, is or can be closed at its opening by a cover and has in at least one of the side walls thereof at least one aperture which is at least indirectly in fluid communication with the ambient air for ventilation purposes.

A chamber may be formed inside the pallet and adjacent to the at least one receptacle, which chamber is connected to the receptacle via the aperture and has at least one outlet towards its underside.

The receptacle may be arranged in the region of one of the feet or one of the skids, in particular in the region of a central foot arranged centrally in the upper deck.

At least one spacer, in particular in the form of a vertically extending rib, may be formed on at least one side wall of the receptacle in order to ensure that air can permeate between a built-in electronic component, which is inserted in the receptacle (18), and the at least one side wall.

The upper deck and the skids or feet may be manufactured as separate parts and then joined together, and at least one of the feet or skids and the upper deck each have corresponding cutouts which in the assembled state form the receptacle.

The at least one aperture may be arranged in the boundary region or joining region between the upper deck and the skids or feet.

The pallet may be manufactured as an injection-moulded plastic part and the receptacle may be integrally formed in the upper deck and/or the feet or skids during the injection moulding.

The cover may be or can be securely clipped into the upper deck and in particular a peripheral seal may be provided between the cover and the receptacle.

The cover may be securely welded to the upper deck.

The cover may be flush-mounted in the upper deck in a state closing the receptacle.

Two receptacles for built-in electronic components may be arranged in the region of the central foot of the pallet.

At least one ventilation hole may be formed in the vertical outer walls of the foot of the pallet that houses the receptacle, said ventilation hole opening into a cavity which is separate from the receptacle and the chamber and which is in fluid communication with these.

The receptacle has a rectangular cross-section.

A built-in electronic component may be arranged in the receptacle.

The built-in electronic component may be an RFID chip, a transponder chip or a sensor unit, in particular a temperature sensor.

A pallet as disclosed herein has an upper deck which forms a loading surface of the pallet, a number of feet or skids which are arranged on the underside of the upper deck, and at least one receptacle for a built-in electronic component. The at least one receptacle is formed in the manner of a blind hole or as a pocket (it does not pass through the pallet, but rather has a bottom at one end) and can be closed at its opening by a cover. At least one aperture for ventilation purposes is formed in at least one side wall of the receptacle. Side walls in this case mean those walls which connect the opening of the receptacle and the bottom of the receptacle. In other words, a pallet is provided which has a receptacle or recess/pocket for accommodating a built-in electronic/electrical component, which receptacle is closed on one side and can be closed on the other side by a cover. At least one ventilation aperture, for example a hole or a slot, which preferably extends horizontally (parallel to the loading surface), is provided in the side walls of the aperture that extend in the intermediate region between the bottom and the cover. The above-described arrangement according to the invention has the advantage that the receptacle offers good protection against water penetrating from outside, but at the same time provides good ventilation so as to avoid condensation.

Preferably, the opening of the receptacle that can be closed by a cover may be arranged in the loading surface of the pallet, so that the side walls in principle extend vertically (perpendicular to the loading surface). Preferably, therefore, the receptacle is or can be closed at the bottom (towards the feet/skids) and at the top (towards the loading surface). Such an orientation of the receptacle facilitates ease of access thereto.

According to one preferred embodiment, the at least one aperture in the side wall of the receptacle may be connected to a pallet interior. To this end, a vertical chamber (a cavity) may preferably be formed inside the pallet and adjacent to the at least one receptacle, which chamber is connected to the receptacle via the at least one aperture or the ventilation hole. With such a design, a gas exchange takes place initially only between the receptacle and an internally located chamber, thereby avoiding any penetration of liquids or dust from outside.

It is advantageous if said adjacent chamber is connected to the surrounding environment via a further aperture, so that an exchange between the air in the receptacle and the ambient air can take place over relatively short distances. With particular preference, the adjacent chamber may extend as far as a lower outer wall of the pallet (in particular of a foot of the pallet), and the aperture of the adjacent chamber may be formed as an outlet in said lower outer wall. In this way, any condensation moisture occurring in the interior of the chamber can drain therefrom. Advantageously, the receptacle and the adjacent chamber may be configured such that water that has condensed in the receptacle can likewise flow off through the outlet in the adjacent chamber. This may be achieved for example by way of suitable slopes in the bottoms of the receptacle and of the chamber.

According to one preferred embodiment of the invention, the receptacle may be arranged in the region of one of the feet or one of the skids. In this way, more space is available in the vertical direction for the receptacle. Preferably, the receptacle may be arranged in the region of a central foot arranged centrally in the upper deck.

According to one preferred embodiment, a ventilation opening may be provided in at least one of the outer (vertical) side walls of the foot that houses the receptacle, said ventilation opening being at least indirectly connected to the receptacle and thus enabling a gas exchange between the receptacle and the surrounding environment.

According to another aspect, at least one protrusion may be provided on the side walls of the receptacle, said protrusion acting as a spacer. In particular, this may be a vertically extending rib, particularly preferably a plurality of ribs on the vertical side walls and/or the bottom side wall of the receptacle. This ensures that air can permeate between an inserted built-in electronic component and the side wall and/or the bottom of the receptacle, and condensation water can run off along the side walls of the receptacle without coming into contact with the built-in electrical component.

According to one preferred embodiment, the upper deck and the skids or feet may first be manufactured as separate parts and then joined together. In such a case, at least one of the feet or skids and the upper deck each have corresponding cutouts which in the assembled state form the receptacle. It is optionally possible to provide such corresponding cutouts which in the assembled state of the pallet form the chamber adjacent to the receptacle. In order to join the pallet together, use may be made for example of connecting means such as screws or bolts, but the pallet parts may also be welded or glued for example.

Preferably, the upper deck and the feet/skids may each have, at their joining regions, complementary support structures, such as ribs for example, which during the joining-together come into contact and enable a transmission of force. The feet of the pallet may therefore be substantially hollow and may be traversed by stiffening ribs. It is advantageous if, in such an embodiment, the stiffening ribs define the side walls of the receptacle and of the chamber adjacent thereto. With particular preference, a gas exchange can be enabled between all the chambers defined by said rib structure via suitable apertures in the ribs.

According to one preferred embodiment of the invention, the aperture which serves as a ventilation hole/slot of the receptacle may be formed in the boundary region/joining region between the upper deck and the skids or feet, that is to say a single cutout or two complementary cutouts may be arranged in the joining zone/interface between the upper deck and the feet/skids.

According to one aspect, at least one ventilation hole may be formed in the outer vertical side walls and/or the outer walls of the foot of the pallet that houses the receptacle. Said ventilation hole may preferably open into a cavity which is separate from the receptacle and which is in fluid communication therewith. With particular preference, said cavity may be a further chamber which is separate from the receptacle and from the above-described chamber adjacent to the receptacle and may be configured to exchange air with the receptacle and with the chamber adjacent to the receptacle.

According to another aspect of the invention, the pallet may be manufactured as an injection-moulded part; preferably, the upper deck and the feet/skids can each be injection-moulded separately. Preferably, the receptacle and or the aperture for ventilation purposes and/or the chamber adjacent to the receptacle is integrally formed in the upper deck and in the feet/skids during the injection moulding.

According to one preferred embodiment, the cover may be securely clipped into the upper deck. To this end, the cover may preferably have latching tongues or protrusions and/or latching hooks which can be snapped into complementary cutouts in the pallet. A peripheral seal may be provided between the cover and the receptacle in order to reliably prevent any penetration of water.

According to one alternative preferred embodiment of the invention, the cover may be securely welded to the upper deck (after the built-in electronic component has been inserted).

According to another aspect of the invention, the cover may be flush-mounted in the upper deck in a state closing the receptacle. The cover thus does not form a hindrance during loading.

According to one preferred embodiment, two receptacles for built-in electronic components may be arranged in the region of the central foot of the pallet. In this way, for example, a transponder or RFID chip for identification purposes and an additional sensor can be integrated in the pallet.

According to one preferred embodiment of the invention, the receptacle may have a rectangular cross-section. With particular preference, at least two of the side walls of the receptacle and or of the chamber adjacent to the receptacle may be formed by reinforcing ribs which are oriented perpendicular to one another.

Another aspect of the invention relates to a pallet unit comprising a pallet according to one of the aspects described above and a built-in electronic component arranged in the receptacle. The built-in electronic component may preferably be an RFID chip, a transponder chip or a sensor unit, in particular a temperature sensor.

The optional and/or preferred features for each aspect of the invention, or concept, set out above are also applicable to any other aspects of the invention, where appropriate.

Embodiments of the present invention will now be described, by way of example only, with reference to the accompanying Figures in which.

Figure 1:
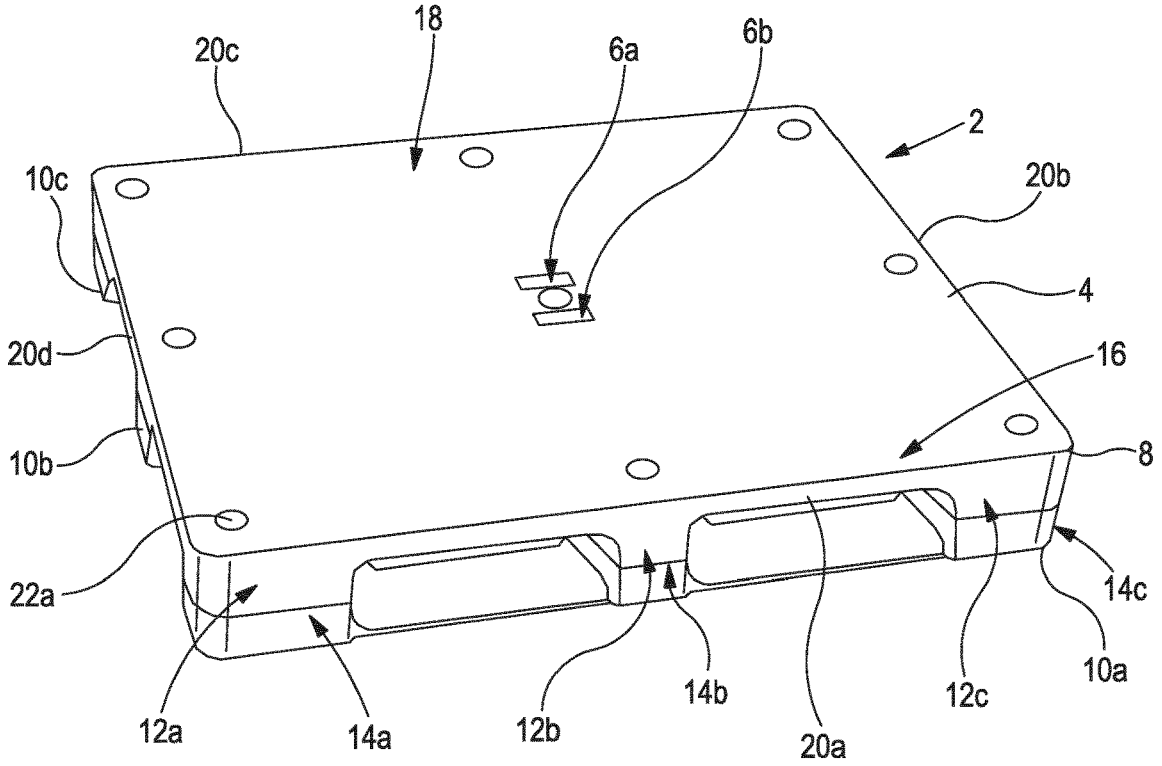
FIG. 1 is a perspective view of a pallet assembly according to the invention.
Figure 3A:
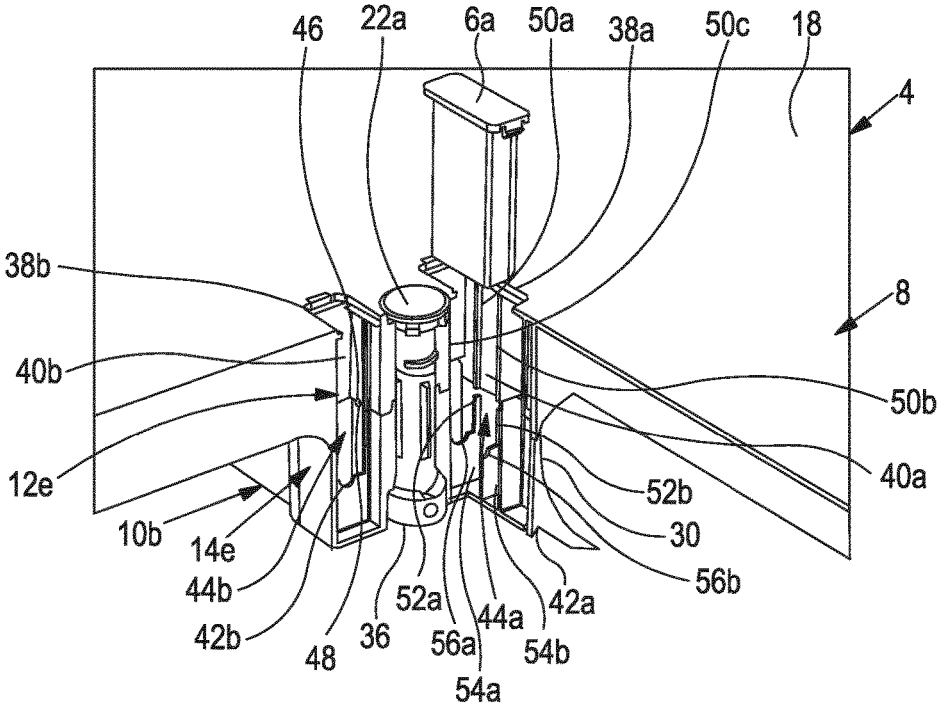
Figure 3B:
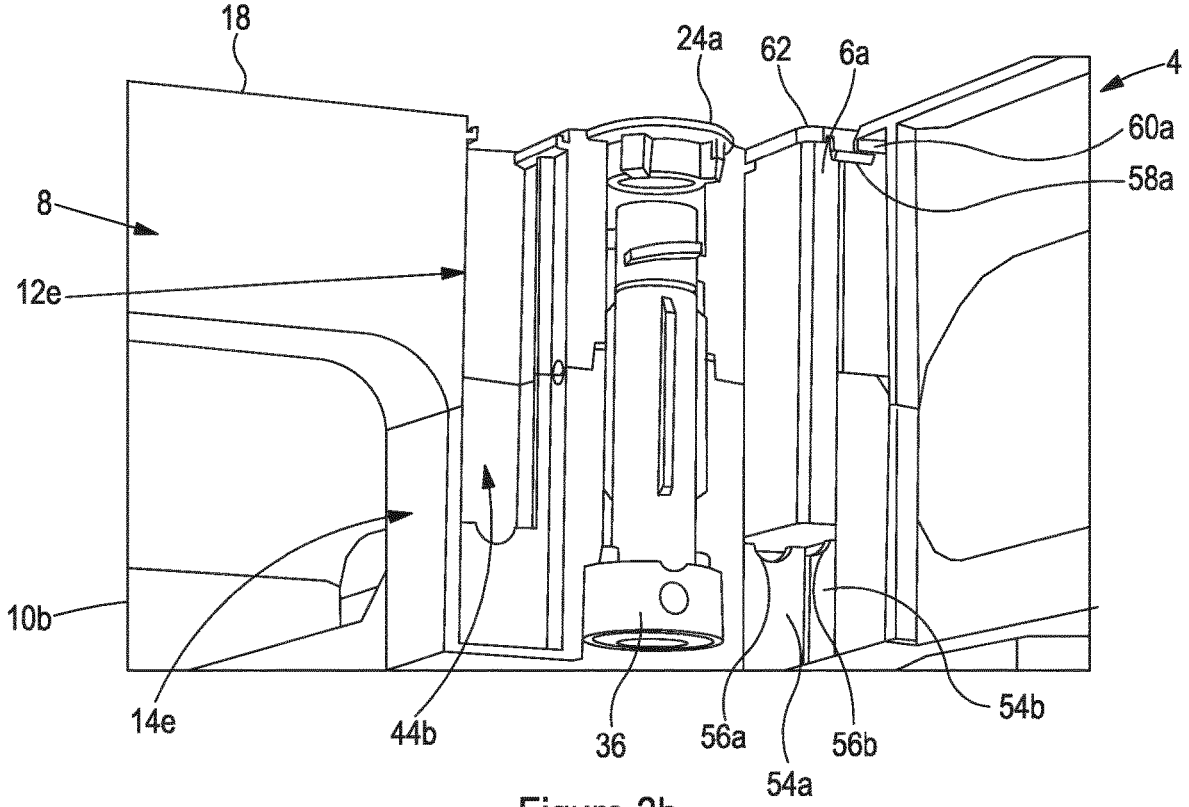
Figure 4:
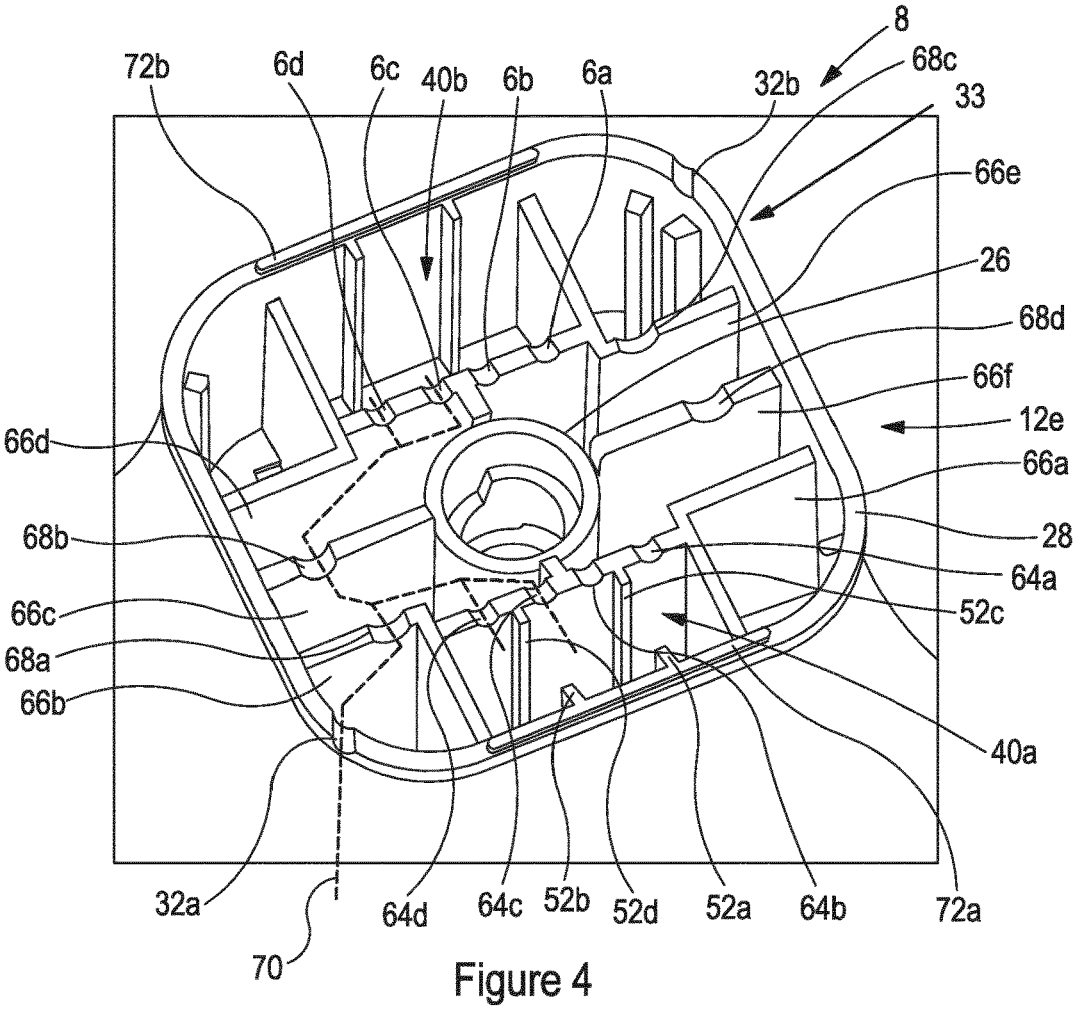
Figure 5:
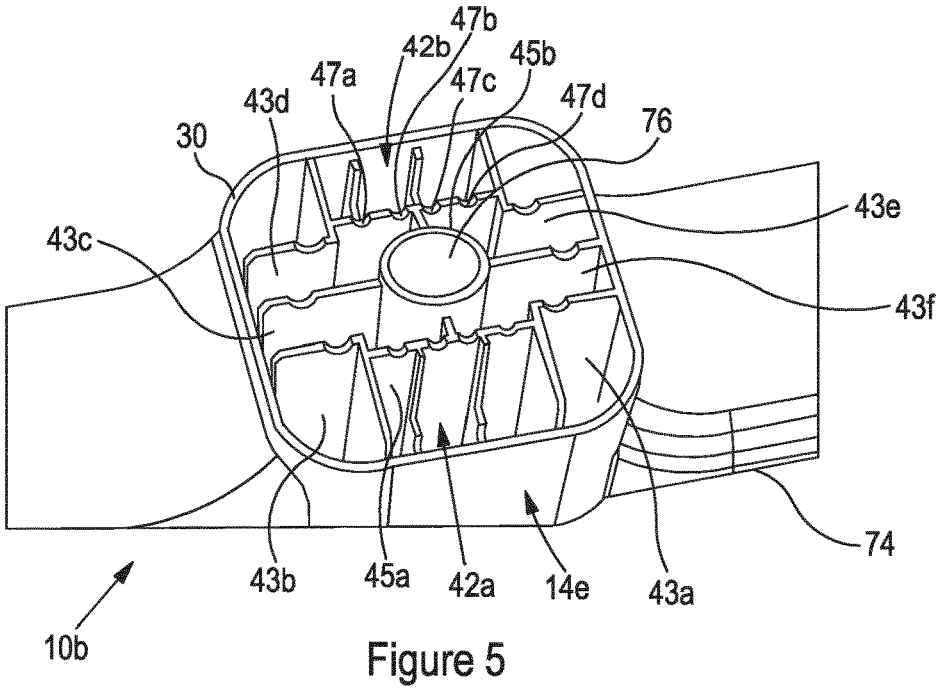
Figure 6:
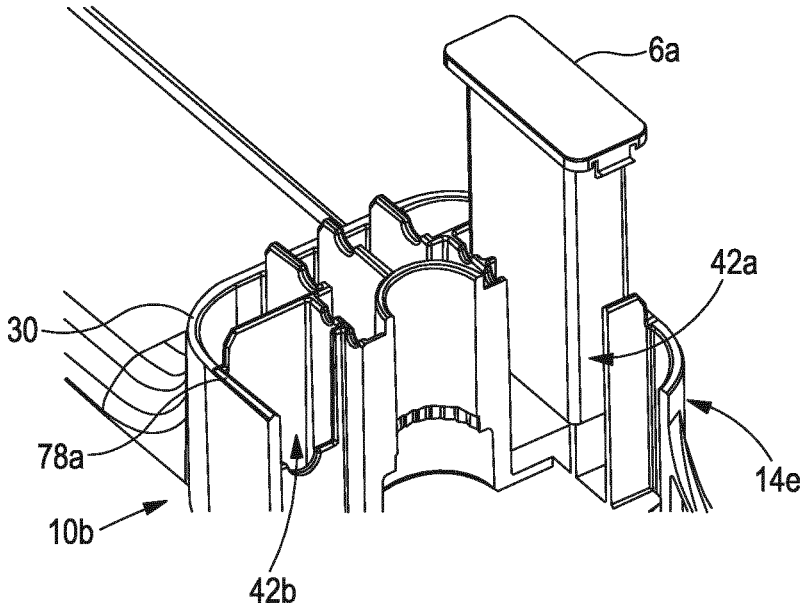
Figure 7A:
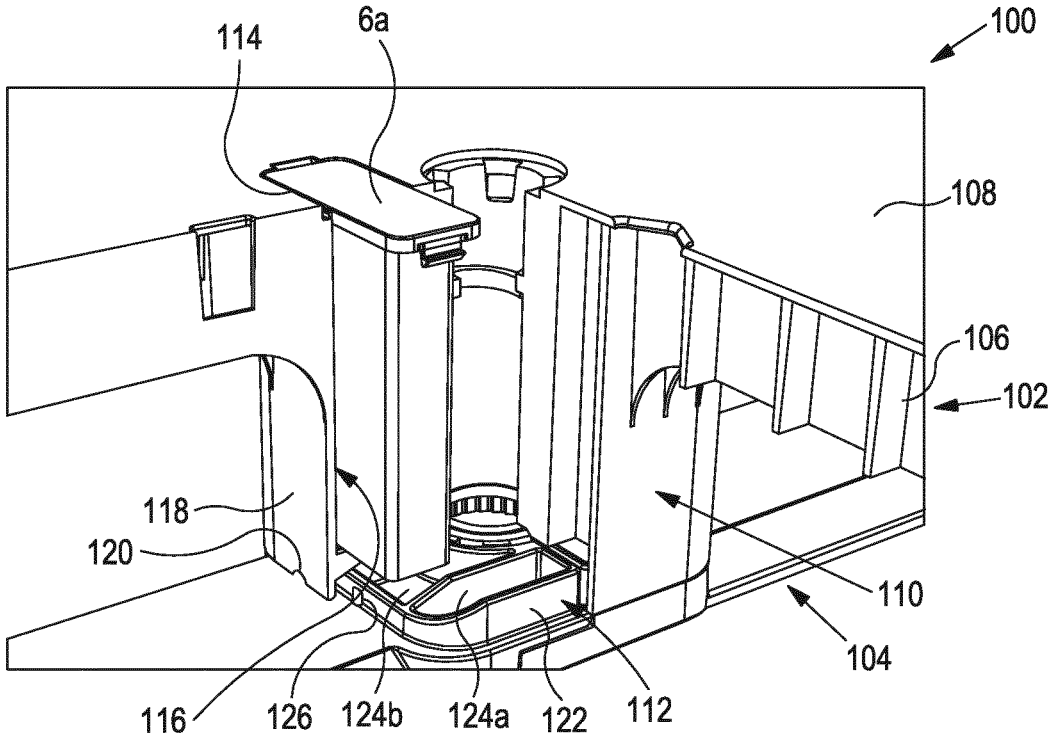
Figure 7B:
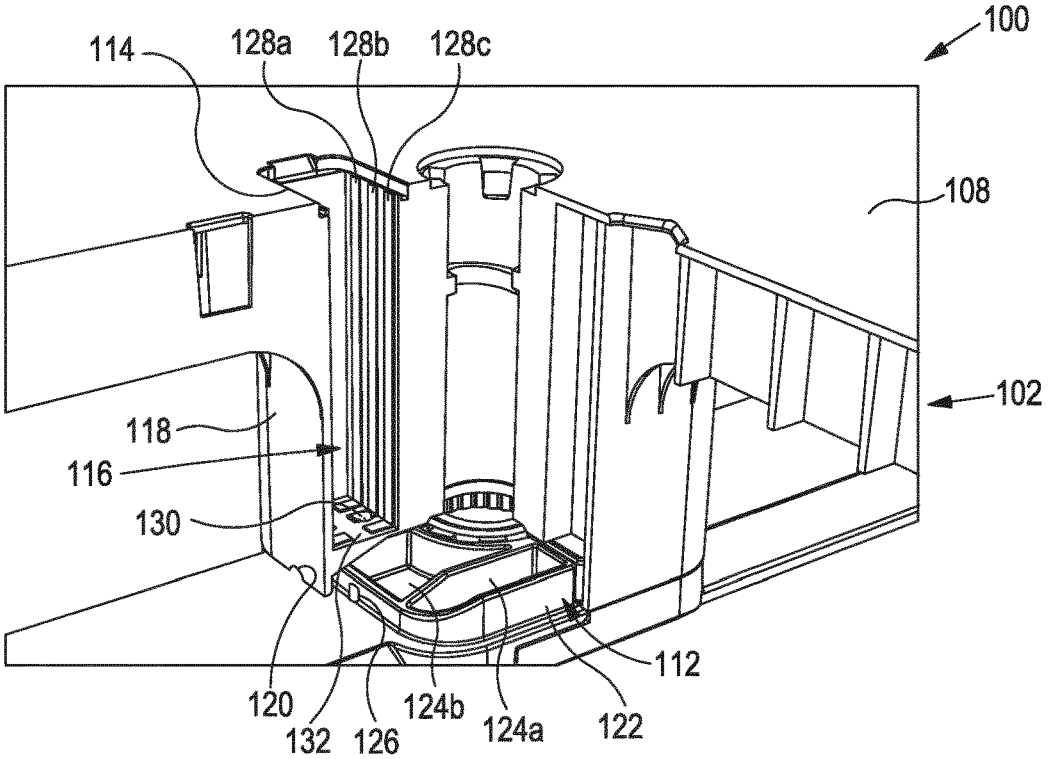
Figure 7C:
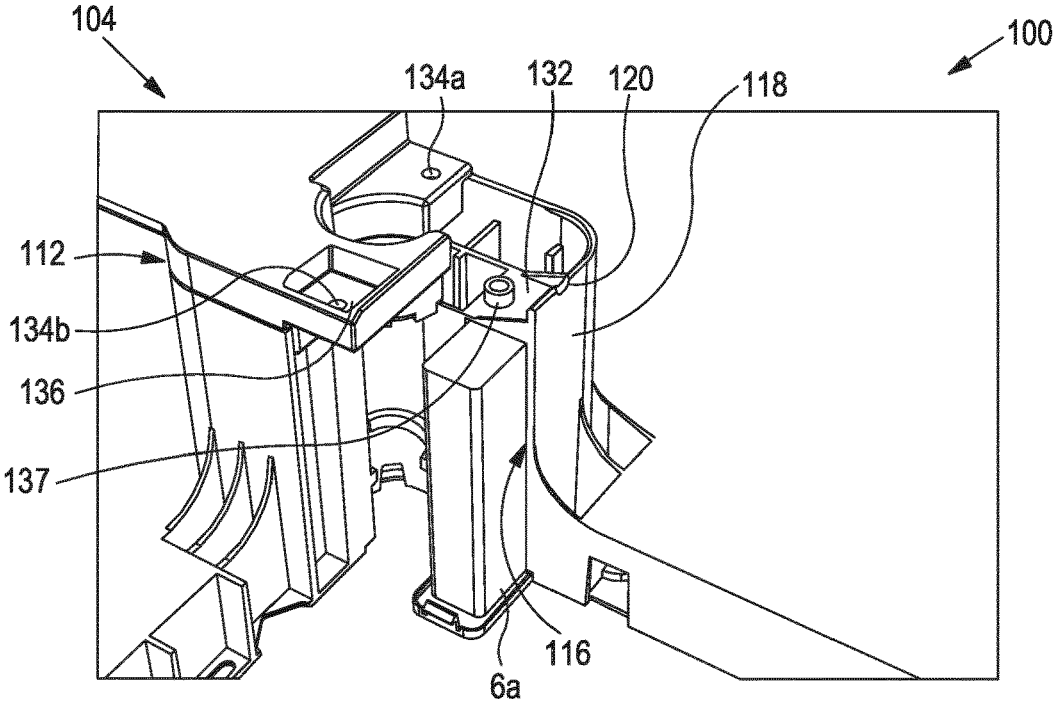

FIG. 3*a* is a partial cutaway view of the pallet of FIG. 1 before an electronic device is inserted;

FIG. 3*b* shows the pallet of FIG. 3*a* with the electronic device inserted in position;

FIG. 4 is a perspective view of an underside of an attachment portion of the platform of the pallet assembly of FIG. 1;

FIG. 5 is a perspective view of a portion of a skid of the pallet assembly shown in FIG. 1;

FIG. 6 is a close up perspective cutaway view of the skid of FIG. 5 with an electronic device shown inserted therein;

FIG. 7*a* is a cutaway perspective view of a pallet assembly according to another embodiment of the invention;

FIG. 7*b* is a view of the pallet of FIG. 7*a* with the electronic device removed;

FIG. 7*c* is a cutaway perspective view of an underside of the pallet assembly of FIG. 7*a;*

Figure 8:
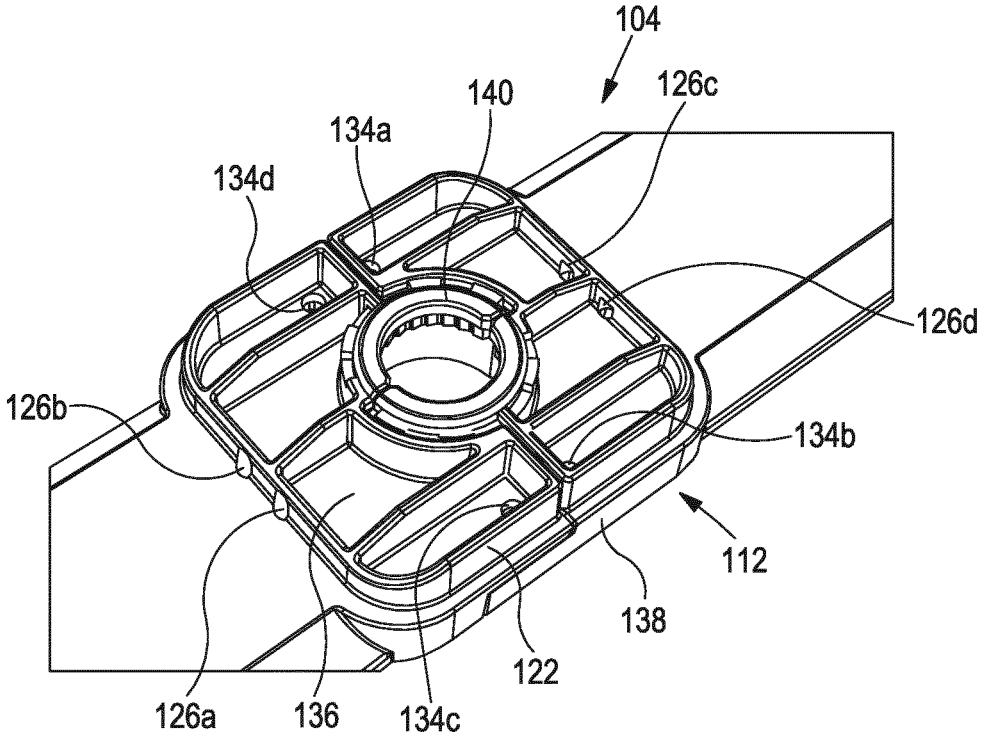

FIG. 8 is a perspective view of a portion of a skid of the pallet as shown in FIGS. 7*a* to 7*c;*

Figure 9A:
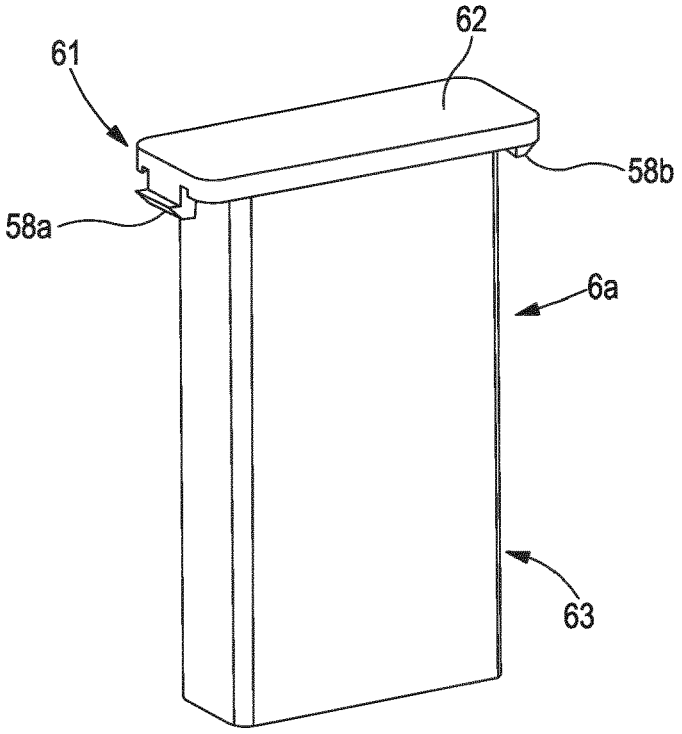
Figure 9B:
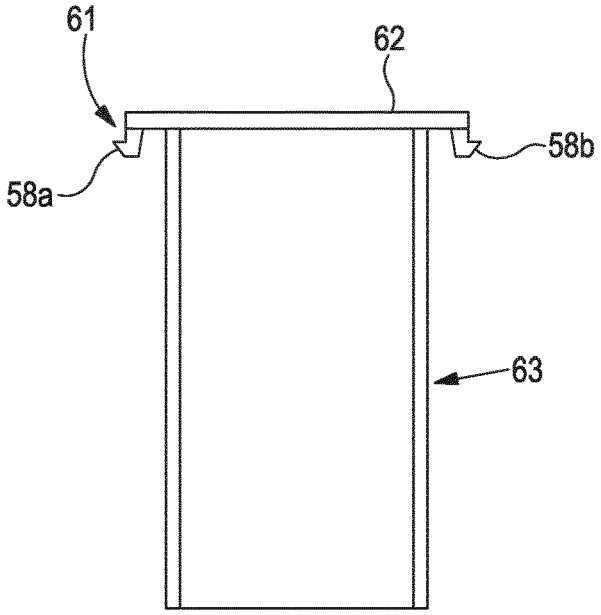

FIG. 9*a* is a perspective view of an electronic device as shown in FIGS. 1-3*b*, 6, 7*a* and 7*c* and according to another embodiment of the invention;

FIG. 9*b* is a front view of the electronic device of FIG. 9*a;*

Figure 10A:
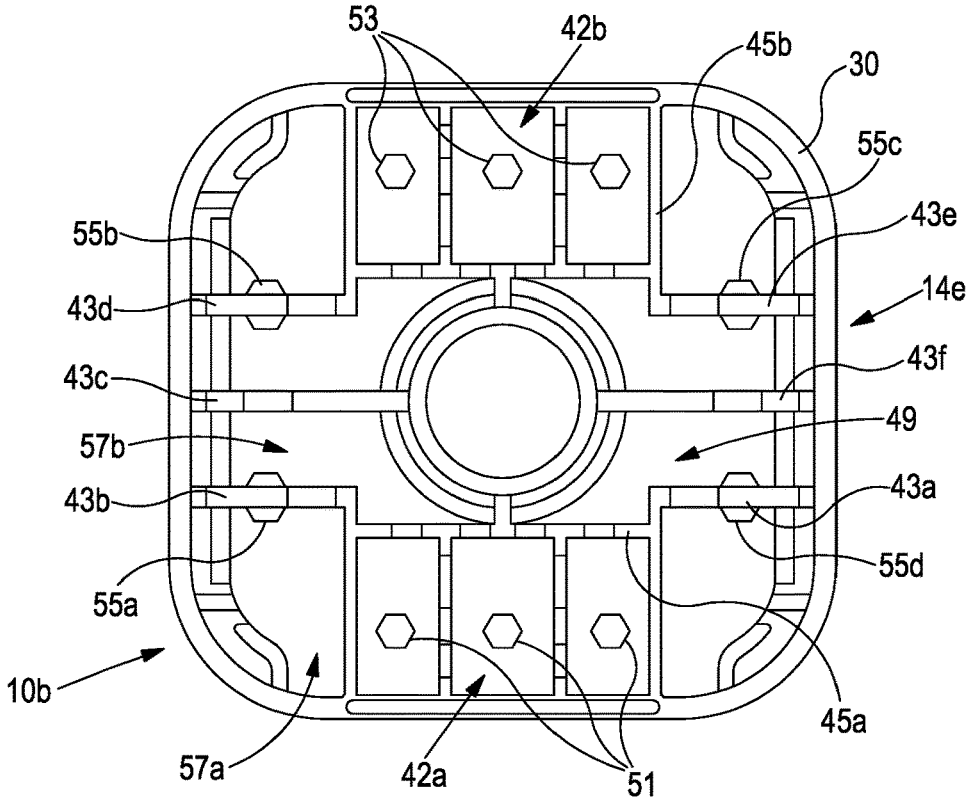
Figure 10B:
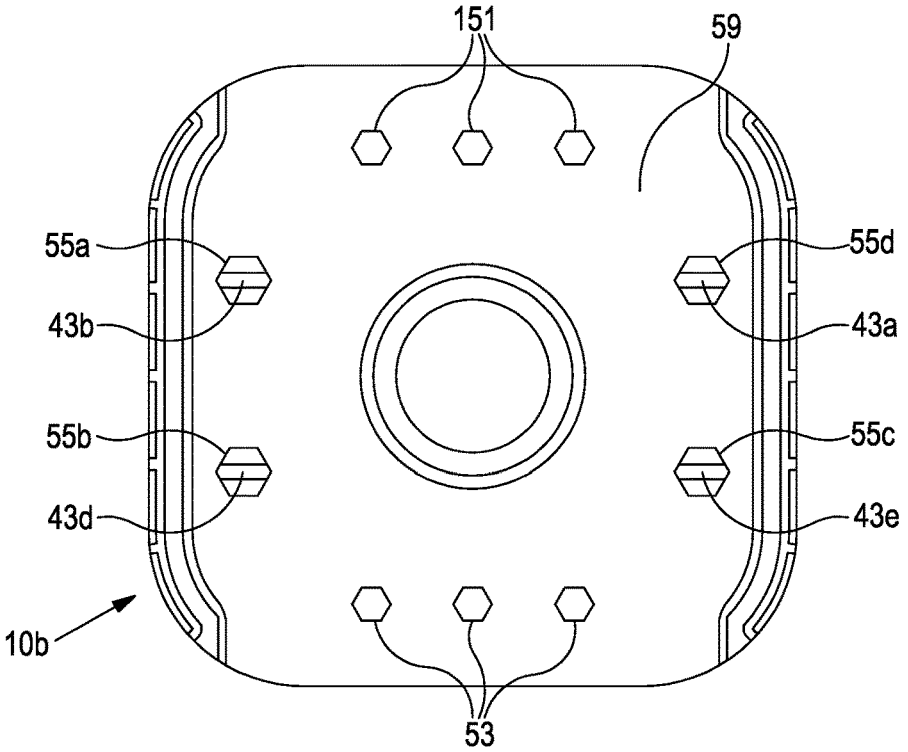

FIG. 10*a* is a plan view of (some of) the portion of the skid shown in FIG. 5 and according to another embodiment of the invention;

FIG. 10*b* is a view from underneath the portion shown in FIG. 13*a;*

Figure 10C:
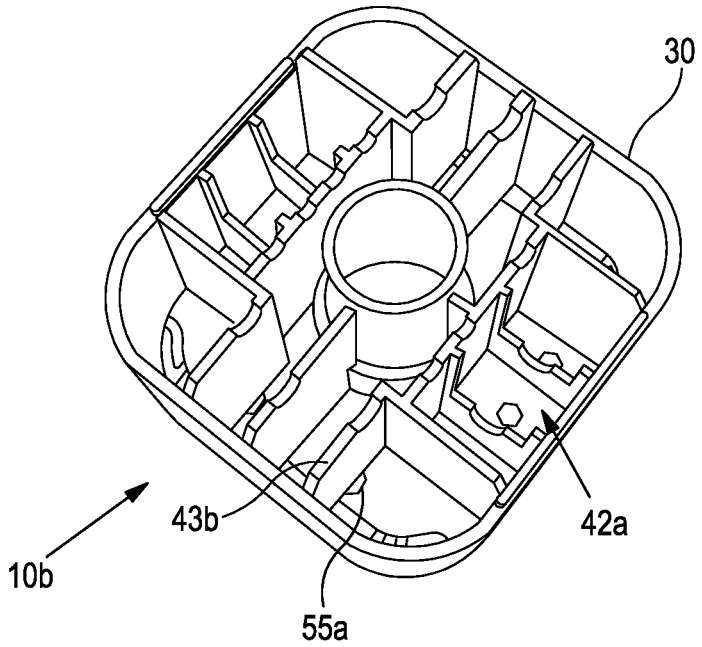
Figure 10D:
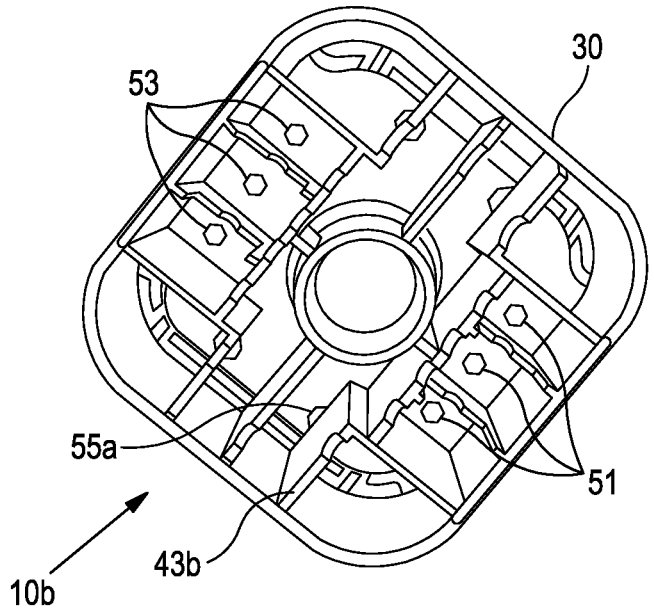

FIGS. 10*c* and 10*d* are angled perspective views of the portion shown in FIG. 10*a;*

Figure 10E:
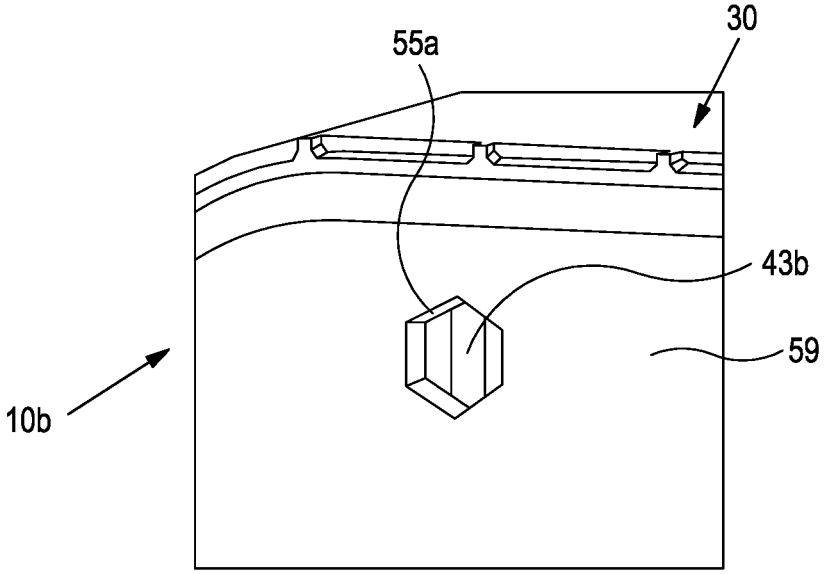

FIG. 10*e* is a magnified and angled perspective view of part of the portion shown in FIG. 10*b;*

Figure 11:
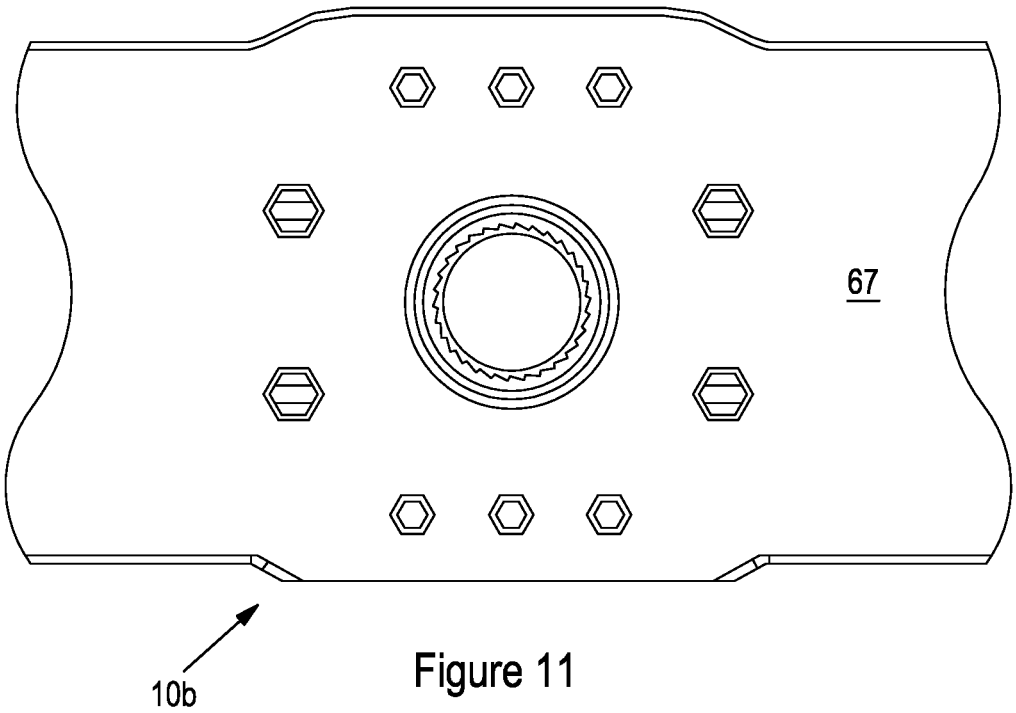
Figure 12:
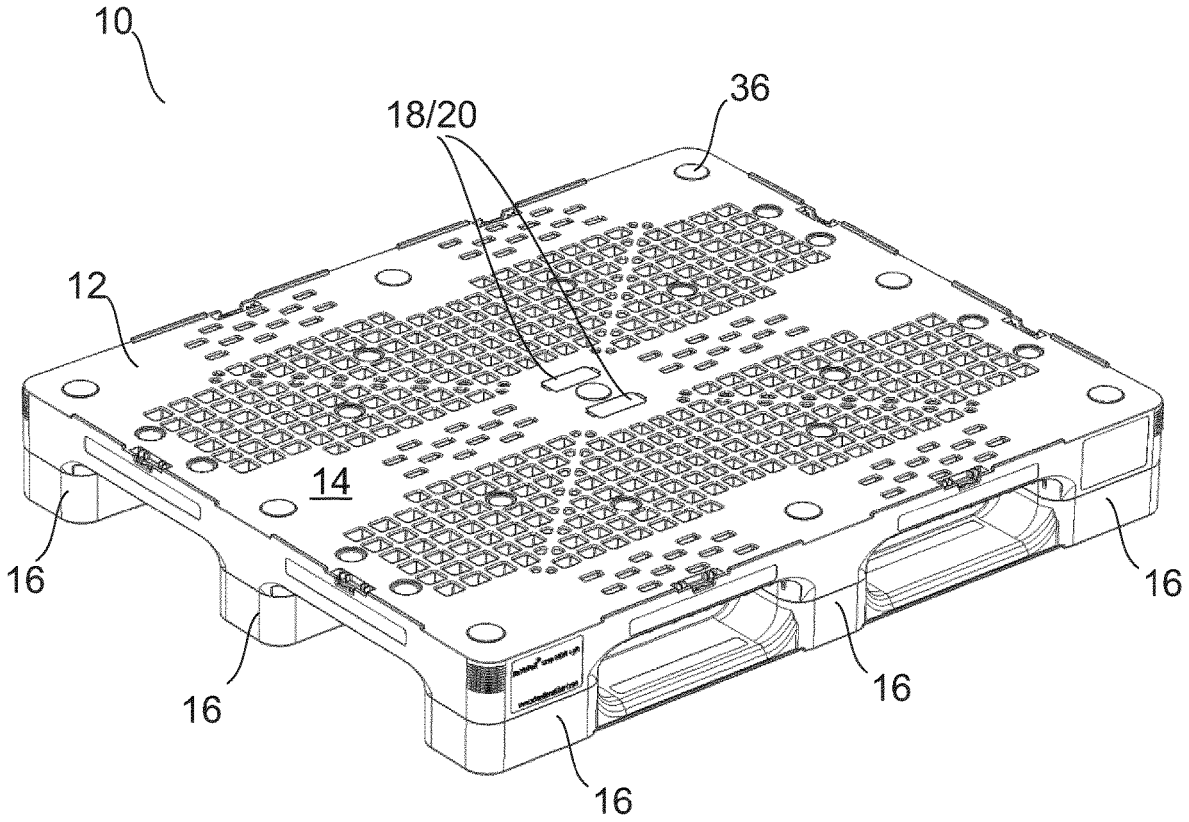
Figure 13:
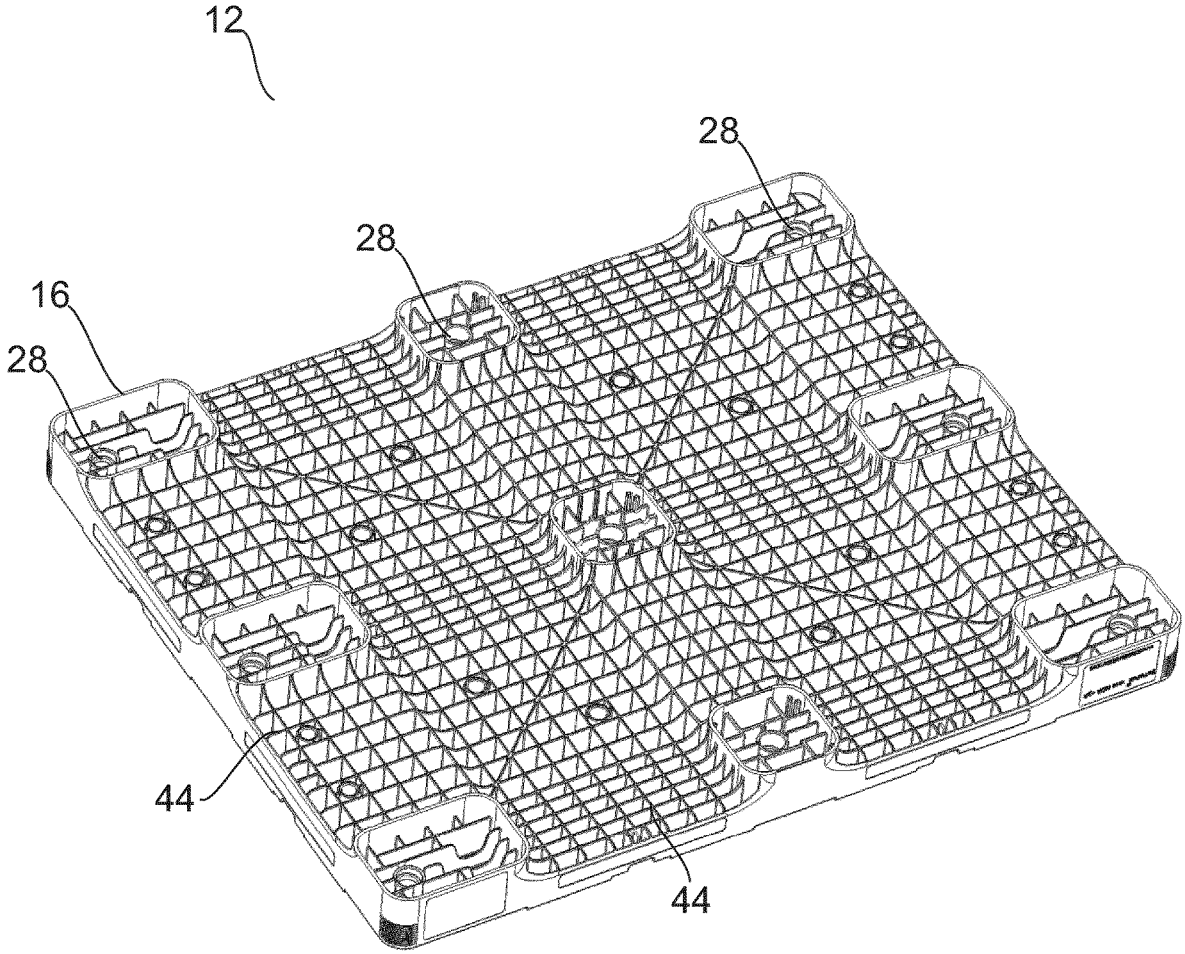
Figure 14:
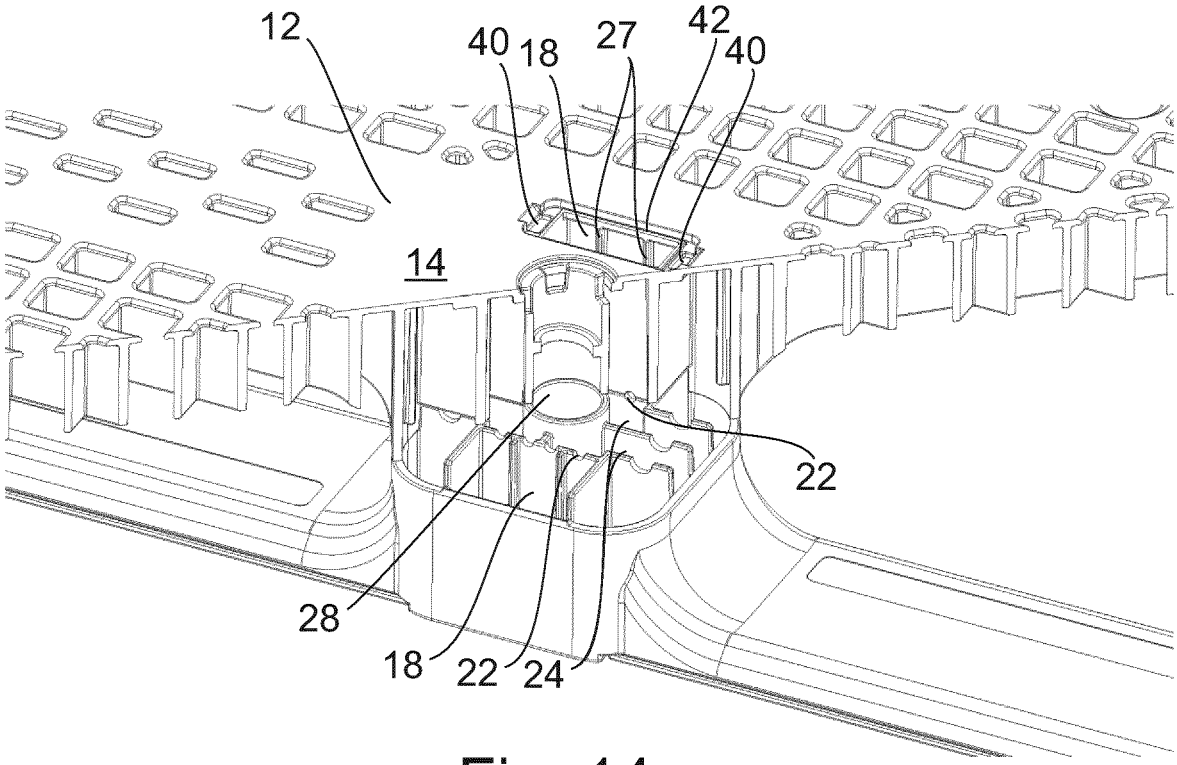
Figure 15:
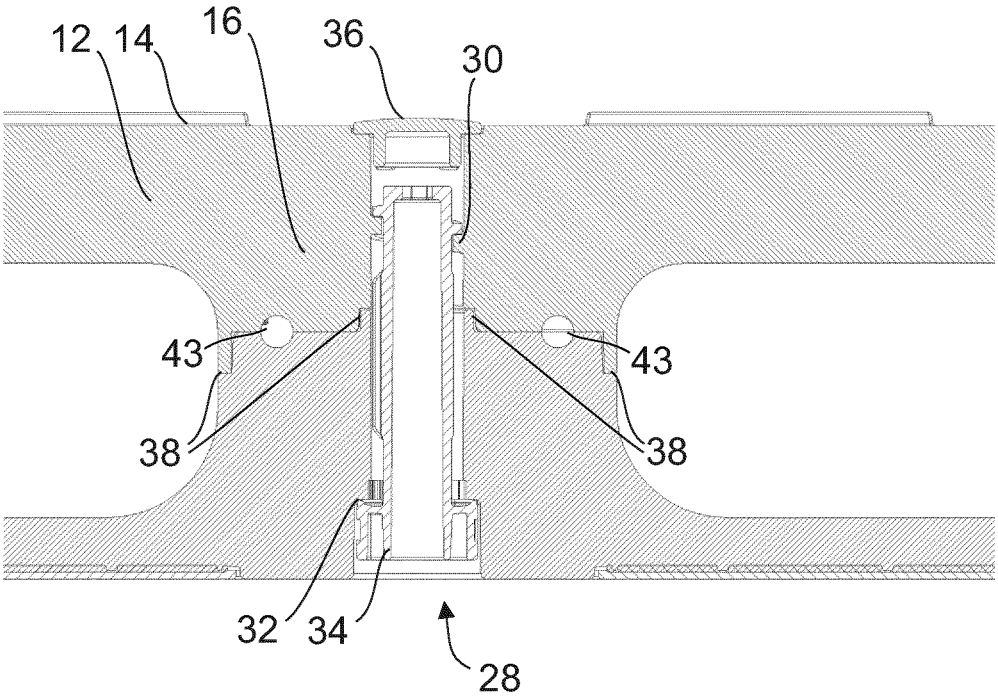
Figure 16:
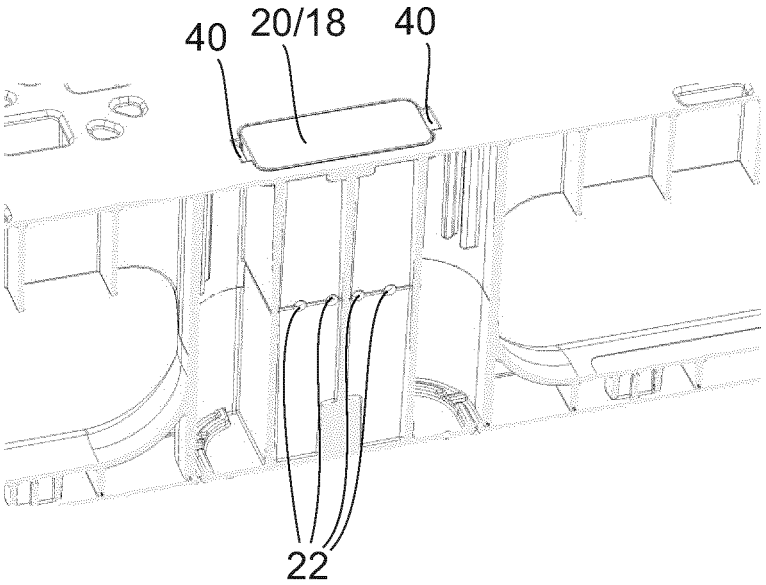
Figure 17:
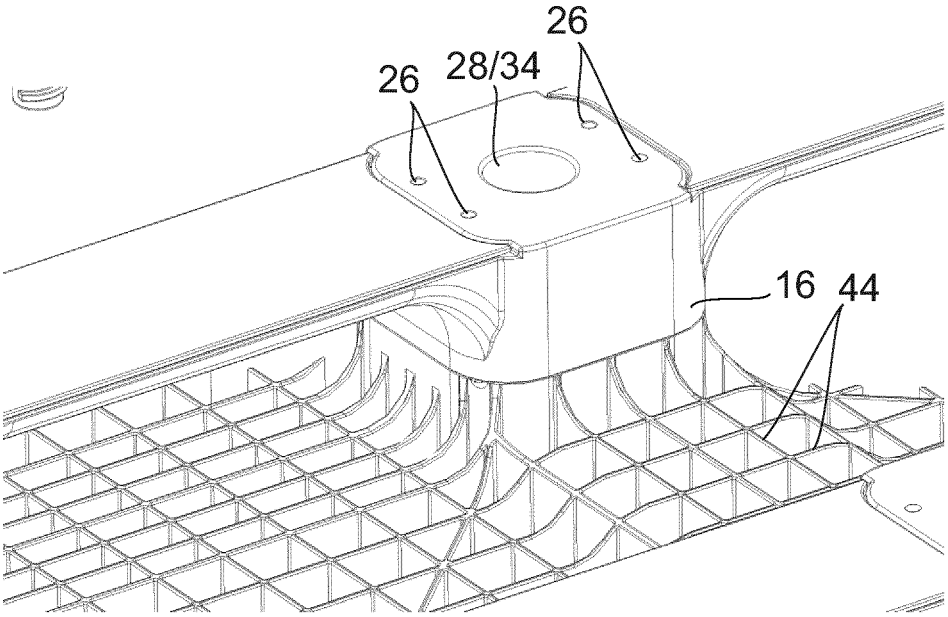
Figure 18:
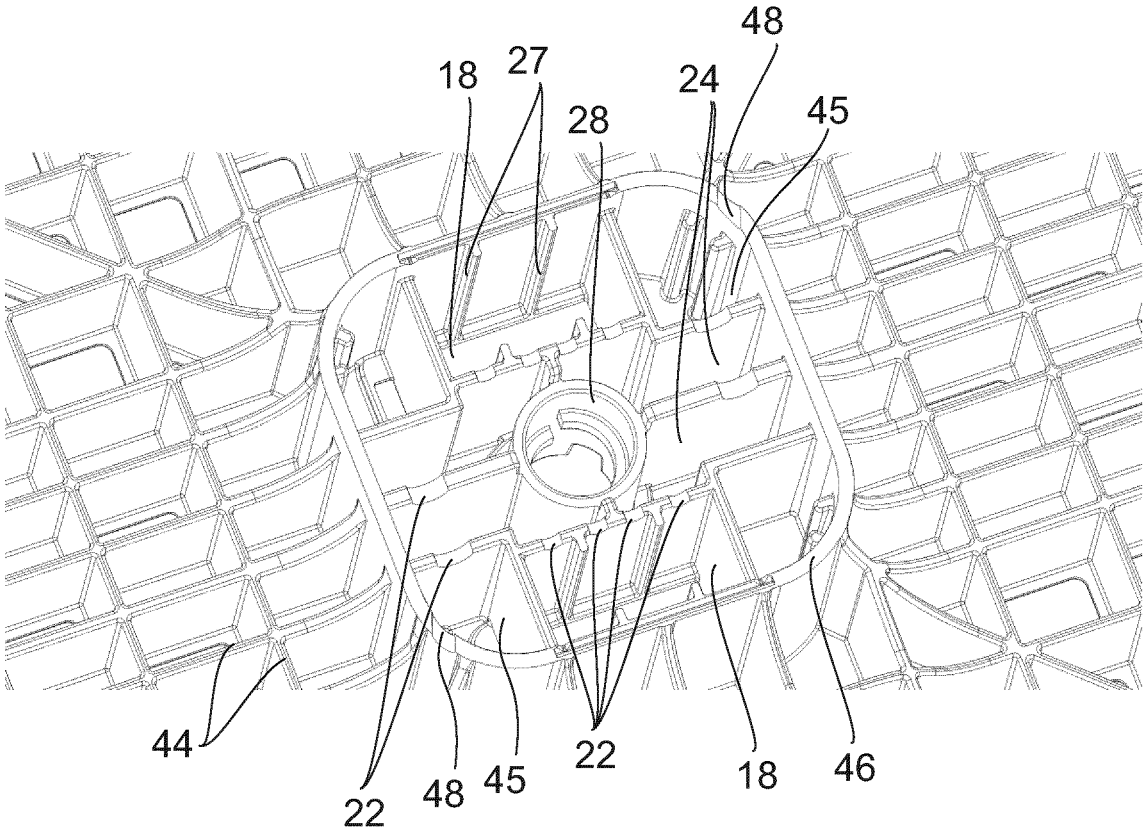
Figure 19:
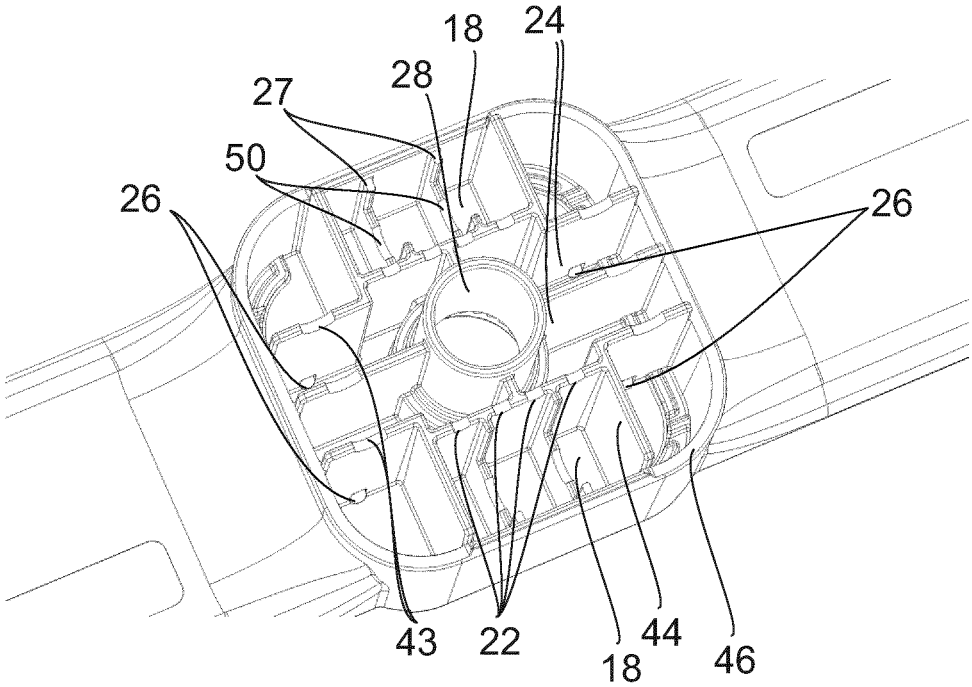

FIG. 11 is an alternative illustration of the portion shown in FIG. 10*b*, with part of a laterally extending support portion indicated schematically;

FIG. 12 is a perspective view of a pallet according to one preferred embodiment of the invention;

FIG. 13 is a view of an upper pallet portion, from below;

FIG. 14 is a perspective partial section through a central foot of the pallet according to the preferred embodiment;

FIG. 15 is a sectional view through the central foot of the pallet according to the preferred embodiment;

FIG. 16 is a perspective view of a cut-open side wall of a receptacle for a built-in electronic component according to the preferred embodiment;

FIG. 17 is a detail view of the underside of a pallet foot according to the preferred embodiment;

FIG. 18 is a detail view of the inner side of an upper pallet foot portion associated with the upper deck, according to the preferred embodiment; and FIG. 19 is a detail view of the inner side of a lower pallet foot portion according to the preferred embodiment.

The present application relates to three primary concepts. The first concept relates to that of a pallet component and a corresponding geometry which provides fluid communication between a device chamber of the pallet component and atmosphere. A second concept relates to a pallet assembly which incorporates an electronic device which provides load sensing functionality, the electronic device being inserted into a device chamber, wherein an end face of the electronic device lies flush with a product supporting surface of the pallet. The third concept relates to a pallet component in which an aperture communicates with a plurality of adjacent internal chambers, such that a single aperture can provide drainage functionality for the adjacent internal chambers. Each of these concepts will be discussed in turn below.

FIG. 1 is a pallet assembly 2. The pallet assembly 2 comprises a pallet 4 with two electronic devices 6*a*, 6*b* inserted in the pallet 4.

The pallet 4 comprises a platform 8 and a plurality of skids 10*a* to 10*c*. The platform 8 is an example of a pallet component. Similarly, the skids 10*a* to 10*c* are examples of a pallet component.

As will be appreciated from the other Figures, the skids 10*a-c* are attached to the platform 8 via attachment portions. Specifically, each of the platform 8 and the skids 10*a* to 10*c* incorporate a plurality of respective attachment portions. When assembled, the attachment portions engage one another as shown in FIG. 1. This will be described in greater detail below.

Although not visible in FIG. 1, the platform 8 incorporates nine separate attachment portions. In the illustrated embodiment, the nine attachment portions are arranged in a 3×3 arrangement. Three attachment portions are at least partly visible in FIG. 1, labelled 12*a-c*. The attachment portions 12*a-c* of the platform 8 engage with corresponding attachment portions 14*a-c* of the skid 10*a*.

The platform 8 comprises a deck, the thickness of which is generally indicated by the reference numeral 16. Deck 16 comprises a product supporting surface 18. The product supporting surface 18 is a generally flat surface upon which goods, products or displays can be supported. A plurality of sidewalls 20*a-d* extend from a periphery of the product support surface 18. The sidewalls 20*a-d* define an outermost periphery of the deck 16.

Although not visible in FIG. 1, nine bayonets (visible in FIGS. 3*a* and 3*b*—labelled 36) secure the platform 8 to each of the three skids 10*a-c*. In FIG. 1 the bayonets are covered by caps, one of which is labelled 22*a* in FIG. 1. Neither the bayonets, nor the caps, are the subject of this application, although more detail regarding the bayonet fitting can be found in WO2013/120595.

Features of primary interest, having regard to the first concept, are that of one or more internal chambers. These internal chambers are disposed within the attachment portions of either or both of the platform 8 and skids 10*a-c*. Again, these will be described in detail below.

Figure 2:
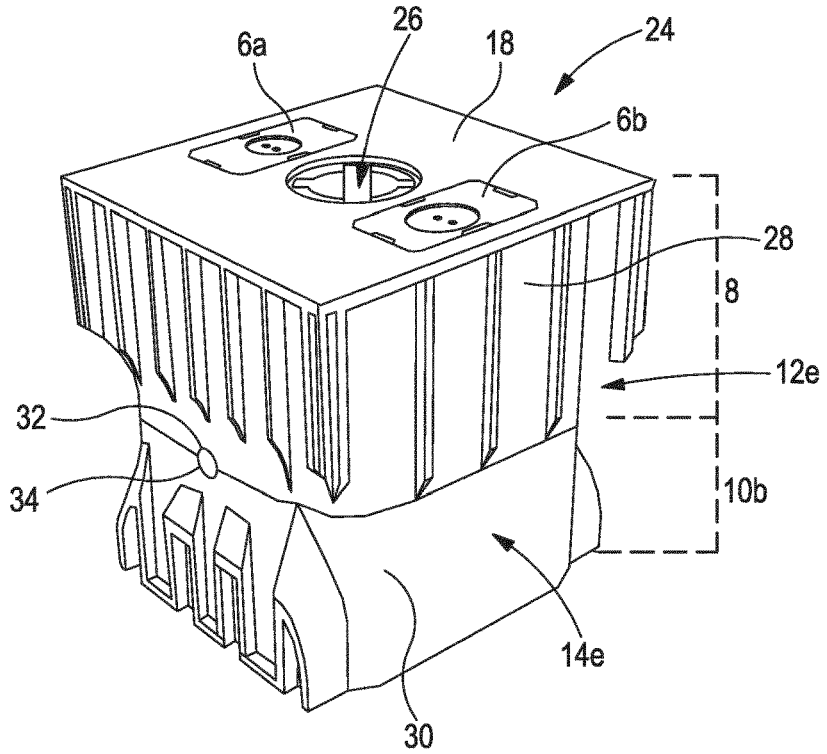
FIG. 2 is a perspective view of a central block of the pallet assembly of FIG. 1 shown in isolation.

FIG. 2 is a close up perspective and cutaway view of a central block 24 of the pallet assembly 2 of FIG. 1. The central block 24 corresponds with the attachment portion located centrally about the platform 8. Specifically, FIG. 2 shows the electronic devices 6*a*, 6*b*, a portion of the product supporting surface 18, a central aperture 26 which is configured to receive a bayonet/cap as described above, and attachment portions 12*e*, 14*e* of the platform 8 and skid 10*b* respectively.

Much of the pallet assembly of FIG. 1 is cutaway in FIG. 2 such that the central block 24 is more clearly visible. As will be appreciated from the exposed ribs and lines of FIG. 2, lengths of the skid either side of the central attachment portion 14*e* have been removed. Similarly, all of the ribs surrounding the attachment portion 12*e* of the platform 8 have been removed such that a ribbed structure underneath the deck 16 is not visible. FIG. 3*b* and FIGS. 4 and 5 show, more clearly, the surrounding structure of the platform 8 and skid 10*b* which are normally present when the "cutaway" of FIG. 2 is not "applied".

Each of the attachment portions 12*e*, 14*e* of the platform 8 and skid 10*b* respectively comprise a perimeter wall 28, 30. The perimeter wall forming part of the attachment portion 12*e* of the platform 8 is labelled 28, whilst the perimeter wall forming part of the attachment portion 14*e* of the skid 10*b* is labelled 30. Each of the perimeter walls 28, 30 surround one or more internal chambers within the attachment portions 12*e*, 14*e*. The arrangement of internal chambers, and their function, will be described below.

Also visible in FIG. 2 are cut-outs 32, 34. The cut-outs 32, 34 are part of the perimeter walls 28, 30 of each of the platform 8 and skid 10*b*. The cut-outs 32, 34 are semi-circular. As such, the cut-outs 32, 34 align to define an aperture which has the geometry of a circle. Cut-outs 32, 34 define a fluid pathway between internal chambers within the attachment portions 12*e*, 14*e* and atmosphere. That is to say, air can flow from the outside to within these chambers. In certain arrangements, and particularly where an electronic device 6*a*, 6*b* is present, the aforementioned fluid pathway can allow the electronic device 6*a*, 6*b* to sample environmental signals or conditions such as temperature and humidity. Furthermore, this functionality is provided whilst not unduly risking damage of the electronic device 6*a*, 6*b* from external impact and/or liquid ingress during cleaning processes such as (high pressure) jet washing. Detail regarding the fluid pathway, the various chambers and cut-outs is provided in the following description and accompanying Figures.

FIG. 3*a* is a close-up perspective cutaway view of the pallet for FIG. 1 indicating how the electronic device 6*a* is inserted.

FIG. 3*a* shows the platform 8 and the skid 10*b*. Also shown is the bayonet 36, and the cap 22*a*, which secures the platform 8 to the skid 10*b*.

As previously mentioned, the platform 8 comprises product supporting surface 18. The product supporting surface 18 incorporates two orifices 38*a*, 38*b*. The orifices 38*a*, 38*b* are openings via which the electronic device 6*a*, 6*b* is received. In the illustrated embodiment the orifices 38*a*, 38*b* are generally rectangular. However, other geometries of orifice could otherwise be used.

As shown in FIG. 3*a*, the attachment portions 12*e*, 14*e* of both the platform 8 and the skid 10*b* each comprise two device chambers. For ease of reference, the device chamber of the attachment portion 12*e* of the platform 8 is labelled 40*a*. The device chamber of the attachment portion 14*e* of the skid 10*b* is labelled 42*a*. The device chambers 40*a*, 42*a*, in use, align with one another and can therefore be considered to define a device enclosure 44*a*. That is to say, the device enclosure 44*a* is shared between the platform 8 and the skid 10*b*. As the pallet 4 is designed to house two electronic devices 6*a*, 6*b*, it logically follows that there are a pair of device enclosures 44*a*, 44*b*. The other device enclosure 44*b* is similarly defined by constituent device chambers 40*b*, 42*b* forming part of platform 8 and skid 10*b* respectively.

FIG. 3*a* therefore indicates the insertion of the electronic device 6*a* from above. Such a top-down insertion is desirable because the need to dismantle the pallet 4 is negated. Furthermore, should the electronic device 6*a* need to be removed from the pallet 4 for servicing reasons, this can again be achieved without dismantling the pallet 4.

Not visible in FIG. 3*a* are the cut-outs 32, 34 of the central block 24 as shown in FIG. 2. The cut-outs 32, 34 are one set of cut-outs which provide fluid communication between the atmosphere and the device enclosures 44*a*, 44*b*. The cut-outs provide the functionality that the electronic devices 6*a*, 6*b* disposed in the device enclosures 44*a*, 44*b* are able to fluidly communicate with the atmosphere. As mentioned, this can provide for environmental signals, such as temperature and humidity, to be sampled. Furthermore, and again as will be described in detail below, because the cut-outs 32, 34 do not provide direct fluid communication, the electronic devices 6*a*, 6*b* remain protected from undesirable liquid ingress such as, for example, water directed at the pallet 4 during a jet washing cleaning process. In other words, the cut-outs 32, 34 define part of a tortuous fluid pathway (i.e. not a direct fluid pathway) which allows for environmental signals to be sampled, via the airflow, whilst preventing undesirable liquid ingress, and so an associated risk of damage to the electronic device 6*a*, 6*b*, in use. That is to say, a jet of water, used as part of a cleaning process, may be prevented from directly entering the device enclosures 44*a*, 44*b*.

Further cut-outs which form part of the fluid pathway are labelled 46, 48. These cut-outs 46, 48 form part of the platform 8 and skid 10*b* respectively. Like the arrangement of cut-outs shown in FIG. 2, the cut-outs 46, 48 of FIG. 3*a* are semi-circular and align with one another to define a generally circular aperture. In the arrangement shown in FIG. 3*a*, and as will be described further below, the cut-outs 46, 48 are in direct fluid communication with the device chambers 40*b* and 42*b*. A further arrangement of cut-outs is shown adjacent the cut-outs labelled 46, 48, but these are not numbered for reasons of clarity. In preferred arrangements, four such cut-outs are present to provide direct fluid communication to each of the device chambers 40*a*, 40*b*, 42*a*, 42*b*. This will be described in more detail in connection with FIG. 4.

Returning to FIG. 3*a*, the device chamber 40*a*, forming part of the platform 8, further comprises a plurality of aligning ribs 50*a-c*. The aligning ribs may otherwise be described as projections and prevent excessive contact between the electronic device 6*a* and walls of the device chamber 40*a* during insertion of the electronic device 6*a*. As suggested by the name, the aligning ribs 50*a-c* also provide an aligning functionality in ensuring that the electronic device 6*a* is properly located within the device chamber 40*a*. Further advantages provided by separating the electronic device 6*a* from the surrounding walls is that the electronic device 6*a* is better protected from impacts to the central block 24, and the risk of damage to the electronic device 6*a* due to leakage of fluids along the surrounding walls is also reduced.

The aforementioned "extra" protection of the electronic device 6*a* is in addition to the fact that the electronic device 6*a* is disposed in the central block which is the best protected "block" of the pallet, owing to it not being exposed to side impacts (i.e. it is surrounded on all sides by other parts of the pallet 8). The central block is also typically the best protected block from handling and transport equipment through the supply chain. The central block location is also the most representative location, across the pallet deck, for sensing environmental signals, such as temperature, moisture and weight. That is to say, sensed signals are more representative of the general pallet condition when taken from the central block. Despite the above advantages of utilising the central block, the invention could otherwise be applied to any block around the pallet (e.g. the blocks adjacent, and surrounding, the central block).

Aligning ribs 50*a-c* preferably extend substantially parallel to the perimeter wall 28 as shown in FIG. 2. Although not described in detail, corresponding aligning ribs are provided in the other device chamber 40*b* in the platform 8.

Considering now the ribs in the device chamber 42*a* in the skid 10*b*, there are two separate varieties of rib present in this chamber. Firstly, like that described in connection with the device chamber 40*a* of the platform 8, in the device chamber 42*a* of the skid 10*b* there are a plurality of aligning ribs 52*a*, 52*b* which project from the perimeter 30. The aligning ribs 52*a*, 52*b* are substantially aligned with the corresponding aligning ribs 50*a*, 50*b* of the device chamber 40*a* of platform 8. However, unlike the previous device chamber 40*a*, the device chamber 42*a* incorporates a further variety of rib. Specifically, the device chamber 42*a* incorporates supporting ribs 54*a*, 54*b*. The supporting ribs 54*a*, 54*b* also project into the device chamber 42*a*. However, unlike the aligning ribs 50*a*, 50*b*, the supporting ribs 52*a*, 52*b* define a ledge. The ledge limits the extent to which the electronic device 6*a* can be inserted into the device enclosure 44*a*. The functionality of the ledge in use is best shown in connection with FIG. 3*b*, which shows the electronic device 6*a* seated within the device enclosure 34*a*.

Returning to FIG. 3*a*, the supporting ribs 54*a*, 54*b* are disposed between respective pairs of aligning ribs 52*a*, 54*b*. That is to say, a combination of the supporting rib, with an aligning rib at either end, may form a continuous wall. As shown in FIG. 3*a*, the supporting ribs 54*a*, 54*b* each incorporate cut-outs 56*a*, 56*b*. The cut-outs 56*a*, 56*b* are semi-circular. In use, the cut-outs 56*a*, 56*b* enable fluid to flow underneath the electronic device 6*a* (see FIG. 3*b*).

Turning to FIG. 3*b*, which is a perspective view of the pallet 4 of FIG. 3*a* with the electronic device 6*a* inserted therein, interaction between various features and the electronic device 6*a* is more clearly illustrated. As with FIG. 3*a*, FIG. 3*b* shows the platform 8 and skid 10*b* attached to one another by the bayonet 36 and cap 22*a*. It is noted that there is a gap indicated between the end of the bayonet 36 and the cap 22*a*, but for the purposes of this application, the exact mechanism used to secure the two pallet components together is not of relevance.

As mentioned above, the supporting ribs 54*a*, 54*b* define a ledge which defines a lower limit of travel of the electronic device 6*a*. Furthermore, cut-outs 56*a*, 56*b* in the supporting ribs allow fluid to flow underneath the electronic device 46*a*. An adjacent empty device enclosure 44*b* shows more clearly the relationship between the supporting rib and the aligning rib in the attachment portion 14*e* of the skid 10*b*.

Also shown more clearly in FIG. 3*b* is the surrounding structure of both the platform 8 and the skid 10*b* which surrounds the respective attachment portions 12*e*, 14*e*. These are the same structures which are removed from the isolated view of FIG. 2.

The retention means which secures the electronic device 6*a* to be pallet 4, specifically the product supporting surface 18 thereof, is also shown in FIG. 3*b*. In the illustrated example, two remaining clips (only one of which is visible in FIG. 3*b*) 58*a* engage corresponding catches in the product supporting surface 18. Only one catch 60*a* is visible in FIG. 3*b*. The combination of the clips 58*a* and catch 60*a* allow the electronic device 6*a* to be snap fitted into the product supporting surface 18, and so the pallet 4. The electronic device 6*a* could otherwise be said to snap fit into the platform 8. The clips 58*a* provide for a tool-less insertion and can be integrally moulded into the chassis of the electronic device 6*a*.

Insertion of the electronic device 6*a* to the extent shown in FIG. 3*b* is advantageous because an end face 62 of electronic device 6*a* lies substantially flush with the product supporting surface 18. This is desirable for a number of reasons including reducing interruption to the product supporting surface 18, and being able to more readily utilise the electronic device 6*a* for load sensing capability. Specifically, having the end face 62 of the electronic device 6*a* lie flush with the product supporting surface 18 means that the electronic device 6*a* can more readily sense loads placed upon the product supporting surface 18. The electronic device 6*a* can sense loads by way of, for example, a strain gauge incorporated at least partly in the end face 62 of the electronic device 6*a*. This provides useful functionality such as being able to monitor stock levels and the distribution of stock on the product supporting surface 18. The end face 62 may be referred to as an upper surface of the electronic device 6*a*. The end face 62 may be said to form part of an integrated lid or cap of the electronic device 6*a*.

Turning to FIG. 4, a magnified view of an underside of the platform 8 is provided. In particular, a close-up view of the attachment portion 12*e* is provided.

In FIG. 4 the perimeter wall 28, and the plurality of internal chambers which it surrounds, are more clearly illustrated.

In this example, the perimeter wall 28 is a single continuous wall which is substantially square with rounded corners. However, alternative geometries of perimeter wall are possible, and the perimeter wall could instead be formed of a number of discrete perimeter wall sections (i.e. not be continuous). FIG. 4 shows the rib structure which surrounds the perimeter wall 28 and which has been removed from the central block 24 shown in FIG. 2. An underside of the central aperture 26 is also clearly visible in FIG. 4.

The perimeter wall 28 comprises a plurality of cut-outs. These cut-outs may be referred to as perimeter wall cut-outs 32*a*, 32*b*. In use, the perimeter wall cut-outs 32*a*, 32*b* enable one or more internal chambers to fluidly communication with the external atmosphere. That is to say perimeter wall cut-outs 32*a*, 32*b* enable fluid to breach the perimeter wall 28. It is noted that the positions of the perimeter wall cut-outs 32*a*, 32*b* differ from the positions of the cut-out 32 of FIG. 2. Specifically, the perimeter wall cut-outs 32*a*, 32*b* are generally disposed at opposite corners of the square geometry defined by the perimeter wall 28. In contrast, the cut-out 32 is disposed along a midpoint of a wall section of the perimeter wall 28 in FIG. 2. The specific positions of the cut-out(s) along the perimeter wall may not be of particular relevance to the invention. As such, the positions of the cut-out of either FIG. 4 or FIG. 2 would be suitable. However, in connection with FIG. 4, and as will be described in more detail below, it is advantageous to have a plurality of perimeter wall cut-outs which are distanced from one another. Also preferable is that the perimeter wall cut-outs are disposed on opposite sides of the perimeter wall. This is so that any sampling of environmental conditions provides a more reliable average between two locations and such that the readings are not significantly affected should one of the cut-outs become either blocked or disposed in an otherwise biasing condition (e.g. in an exhaust flow or some other unrepresentative hot/cold 'spot').

The position of the perimeter wall cut-outs 32*a*, 32*b* can provide further functionality in that they can 'direct' external water jets towards particular walls. That is to say, a central axis of the perimeter wall cut-out(s) may be aligned with a partition wall. More preferably, the central axis is offset from any (other) cut-outs. This is indicated in FIG. 4 by the arrow 33, which represents a water jet from a cleaning process. Because of the alignment of the perimeter wall cut-out 32*b*, the jet 33 does not impinge, or penetrate, a partition wall cut-out 38*c*. Most of the liquid from the jet 33 will therefore be retained within the boundary of the corresponding corner chamber (i.e. will not reach the device chamber). Said retained liquid can then exit the corner chambers via corresponding drainage holes in the corresponding chambers in the skid 10*b*, by gravity. This further assists in reducing undesirable liquid leakage into the device chambers. The same functionalities are provided by the other perimeter wall cut-out 32*a*.

As described in connection with FIGS. 3*a* and 3*b*, the attachment portion 12*e* comprises two device chambers 40*a*, 40*b*. For ease of reference, the device chambers 40*a*, 40*b* will be referred to as a first device chamber 40*a* and a second device chamber 40*b* respectively. As described in connection with FIGS. 3*a* and 3*b*, each of the device chambers 40*a*, 40*b* are configured to at least partially receive an electronic device therein. Furthermore, and as will be numbered only in connection with the first device chamber 40*a*, each of the device chambers comprises a plurality of aligning ribs 52*a-d*. Aligning ribs 52*a-d* are provided as opposing pairs of ribs.

As will be appreciated from FIG. 4, as well as the central aperture 26 and two device chambers 40*a*, 40*b* which are disposed within the perimeter wall 28, there are a number of other chambers also disposed within the perimeter wall 28. Specifically, in the illustrated arrangement there is a corner chamber disposed at each rounded corner of the perimeter wall 28. Furthermore, there are four central chambers disposed around the central aperture 26. The various chambers are defined at least in part by either the perimeter wall 28, central aperture 26, device chambers 40*a*, 40*b* and/or further partition walls. Many of the various chambers and/or walls further incorporate cut-outs to provide fluid communication between the external atmosphere and the device chambers 40*a*, 40*b*. These cut-outs define the fluid pathway which penetrates the perimeter wall 28 and allows environmental signals to be sampled.

Beginning with the first device chamber 40*a*, this chamber comprises four cut-outs 64*a-d*. These cut-outs 64*a-d* may be referred to as device chamber cut-outs, owing to their position. The device chamber cut-outs 64*a-d* are arranged in a cut-out array along one long side of the device chamber 40*a*. Like cut-outs are provided in the second device chamber 40*b*, these cut-outs are labelled 65*a-d*.

As illustrated in FIG. 4, a number of partition walls are also present in the attachment portion 12*e*. For the purposes of this document, the partition wall is intended to refer to any wall, within the perimeter wall 28, which does not define either of the device chambers 40*a*, 40*b*. Partition walls are therefore indicated with reference numerals 66*a-f*. Partition walls 66*a*, 66*b*, 66*d* and 66*e* at least partly define corner chambers within the attachment portion 12*e*. Said partition walls define the corner chambers in co-operation with at least one wall which defines either of the device chambers 40*a*, 40*b*. Central partition walls 66*c* and 66*f* each extend from an opposing side of the perimeter wall 28 up to the central aperture 26. The central partition walls 66*c*, 66*f* are examples of partition walls.

As will be appreciated from FIG. 4, some of the partition walls 66*a-f* also incorporate cut-outs 68*a-d*. The cut-outs 68*a-d*, which may be referred to as partition wall cut-outs, at least partially define the fluid pathway between the atmosphere and the device chambers 40*a*, 40*b*.

An example fluid pathway is indicated with reference numeral 70 in FIG. 4. As will be appreciated from the dashed line, the fluid pathway 70 begins at the perimeter wall cut-out 32*a*, and then passes through partition wall cut-out 68*a* (a cut-out in the partition wall 66*b* in closest proximity to the perimeter wall cut-out 32*a*). At this point, the pathway separates and either enters the first device chamber 40*a* via device chamber cut-outs 64*c* and also 64*d*, or continues to flow towards a further partition wall cut-out 68*b* in central partition wall 66*c*. From this point, that flow then again enters second device chamber 40*b* via device chamber cut-outs 66*c* and/or 66*d*.

Further features shown in FIG. 4 are those of chamfers 72*a*, 72*b* disposed along portions of the perimeter wall 28. The chamfer may otherwise be referred to as a leakage reducing chamfer. The chamfers 72*a*, 72*b* are provided along portions of the perimeter wall 28 which are adjacent to the device chambers 40*a*, 40*b*. That is to say, the chamfers 72*a*, 72*b* occupy lengths of the perimeter wall 28 which are directly disposed between the device chambers 40*a*, 40*b* and the atmosphere. The chamfers 72*a*, 72*b* assist with reducing unwanted liquid leakage (specifically water ingress) into the device chambers 40*a*, 40*b*. This is achieved by the chamfers 72*a*, 72*b* providing a tortuous path between an external side of the perimeter wall 28 and the device chambers 40*a*, 40*b*. This can assist in protecting any electronic device inserted into the device chambers 40*a*, 40*b* against damage from, for example, processes such as jet washing (i.e. cleaning the pallet).

By providing the chamfers 72*a*, 72*b* along only the portions of the perimeter wall 28 which are most susceptible to providing a leakage path to the electronic devices inserted in the device chambers 40*a*, 40*b*, the material usage and cost is kept to a minimum whilst the device chambers 40*a*, 40*b* remain protected.

Overall, from FIG. 4 it will be appreciated that the various walls, device chambers and cut-outs cooperate to provide an arrangement which defines a fluid pathway to substantially prevent liquid ingress into the device chambers whilst allowing electronic devices to sample temperature and/or humidity, among other variables. Put simply, gases (such as air) can enter the device chambers, whilst liquids (such as water) generally cannot. The fluid pathway may therefore otherwise be referred to as an airflow pathway. Furthermore, this is achieved in a low cost and really manufactured fashion due to the arrangement of the cut-outs.

It is noted that all of the cut-outs of FIG. 4 are disposed in an end face of the respective wall. This is a particularly simple geometry to manufacture because the cut-outs can be present during the injection moulding process i.e. they do not need to be created by drilling bores in already formed material. However, in other arrangements, the cut-outs may take the form of apertures drilled through the prospective chambers and/or partition walls. The end face of the walls may be referred to as a partition face, owing to two abutting end faces defining a partition line between two adjacent components.

FIG. 5 is a perspective view of a portion of a skid 10*b* in accordance with the invention. The skid 10*b* comprises attachment portion 14*e* and support portion 74. As explained above, the skid 10*b* is an example of a pallet component. Where the pallet component is a skid 10*b*, the support portion 74 is for, or configured to, support the skid on a surface.

Also shown in FIG. 5 is the perimeter wall 30 of the attachment portion 14*e*. A central aperture 76 extends through the attachment portion 14*e*. The central aperture 76 of the skid 10*b* aligns with the central aperture 26 of the platform 8.

Also shown in FIG. 5 are the device chambers 42*a*, 42*b*. Finally, various partition walls, and device chamber walls, are also shown in FIG. 5 (but are not labelled). As will be appreciated from FIG. 5, the various partition walls and device chamber walls project beyond the perimeter wall 30 in a vertical direction. This is in contrast to the partition walls 66*a-f* and device chamber walls of FIG. 4 which are recessed relative to the perimeter wall 28. It will be appreciated that this arrangement provides for an abutment of the respective partition walls and device chamber walls at a position which is vertically offset from that of the point where the perimeter walls 28, 30 meet. This further improves the resistance of the device chambers to the ingress of fluid, owing to the more tortuous path which any fluid must traverse in order to reach the device chambers from outside the respective attachment portions 12*e*, 14*e*. More detail regarding the arrangement of walls and device chambers, and cut-outs incorporated therein, is provided in connection with FIG. 6.

A distinction between the arrangements shown in FIGS. 4 and 5 is that, in FIG. 5, the perimeter wall 30 does not incorporate any cut-outs. Instead, cut-outs are disposed in partition walls 43*a-f* and walls 45*a*, 45*b* defining the device chambers 42*a*, 42*b*. Four such cut-outs are numbered 47*a-d* in wall 45*a*.

It will be appreciated that the aforementioned walls 43*a-f*, 45*a*, 45*b*, specifically cut-outs therein, define at least part of a fluid pathway between the device chambers 42*a*, 42*b* and the atmosphere in use. When the attachment portion 14*e* of the skid 10*b* engages a corresponding attachment portion 12*e* of the pallet 8, the perimeter wall 30 of the skid 10*b* abuts the perimeter wall 28 of the platform 8. Cut-outs 32*a*, 32*b* (see FIG. 4) in the perimeter wall 28 of the platform 8 therefore enable an interior of the attachment portions 12*e*, 14*e* to fluidly communicate with external atmosphere. In this instance, interior is intended to mean a region inboard of the perimeter wall. The other cut-outs in the attachment portions 12*e*, 14*e* in both the skid 10*b* and platform 8 then allow the device chambers 40*a*, 42*a*, 40*b*, 42*b* (which define device enclosures 44*a*, 44*b*) to fluidly communicate with external atmosphere. Cut-outs in a perimeter wall may therefore only be incorporated in one pallet component (i.e. one of the platform 8 or the skid 10*b*). Similarly, cut-outs in the other walls may only be incorporated in one pallet component. Alternatively, cut-outs may be provided in both pallet components, or distributed between the pallet components (i.e. one pallet component may incorporate some cut-outs, whilst the other pallet component incorporates other cut-outs).

FIG. 6 is a close up perspective cutaway view of the skid 10*b* of FIG. 5 with an electronic device 6*a* received in the first device chamber 42*a*. Many of the features of the attachment portion 14*e* of the skid 10*b* are the same as those described in detail in connection with the attachment portion 12*e* of the platform 8 of FIG. 4. As such, detailed description in connection with FIG. 6 will not be provided. However, of note, once again a plurality of partition walls, and device chamber walls, with cut-outs therein provide fluid communication via a fluid pathway between atmosphere and one or more device chambers surrounded by the perimeter wall 30. A chamfer 78*a* is incorporated along a portion of the perimeter wall 30 adjacent the second device chamber 42*b*. This chamfer 78*a* cooperates with a corresponding chamfer 72*a* of the platform 8 to provide a tortuous path which was described in connection with FIG. 4 (i.e. it assists in [greatly] reducing liquid ingress).

Turning to FIG. 7*a*, a further embodiment of the invention is illustrated. In FIG. 7*a*, a partially cutaway perspective view of a central block of a half pallet 100 is shown. The half pallet 100 comprises a platform 102 and a skid 104. The platform 102 is formed of a deck 106, which comprises a product supporting surface 108, and an attachment portion 110. Like that of the attachment portion described in connection with the previous embodiment, attachment portion 110 is configured to engage a corresponding attachment portion of another pallet component, in this instance an attachment portion 112 of the skid 104. FIG. 7*a* may be said to show a pallet assembly, owing to the presence of the electronic device 6*a* inserted in the pallet 100.

Beginning with the platform 102, like the platform 8 described in connection with the previous embodiment, the platform 102 comprises an orifice 114 in the product supporting surface 108. This orifice 114 provides an opening through the product supporting surface 108 into a device chamber 116. The device chamber 116 is configured to receive an entirety of the electronic device 6*a*. The device chamber 116 therefore fully receives the electronic device 6*a*. This is a distinction between the previous embodiments in which the perspective device chambers only received part of the electronic device 6*a*. Furthermore, unlike the previous embodiment only one orifice 114 is provided in the product supporting surface 108. This may be due, at least in part, to the platform 102 being smaller than the platform 8, and thus less space being available for the incorporation of any electronic devices.

The attachment portion 110 of the platform 102 is defined by a perimeter wall 118 in the same manner as the previous embodiment. As with the previous embodiment, the perimeter wall 118 comprises a cut-out 120 which defines a fluid pathway between the device chamber 116 and the external atmosphere. The exact route of the fluid pathway will be described in connection with the other figures.

Returning to FIG. 7*a*, and focussing on the skid 104, the skid 104 also comprises the attachment portion 112. The attachment portion 112 is defined, at least in part, by a perimeter wall 122. The perimeter wall 122 surrounds a plurality of internal chambers, two of which are labelled with reference numerals 124*a* and 124*b*. In this embodiment, the internal chambers 124*a*, 124*b* do not receive any part of the electronic device 6*a*. Instead, these internal chambers 124*a*, 124*b* merely provide a support structure and tortuous path (i.e. not a direct path) to reduce the likelihood of fluid ingress into the device chamber 116.

The perimeter wall 122 comprises a cut-out 126, this cut-out again defining, when assembled, a fluid pathway between the device chamber 116 and the atmosphere.

FIG. 7*b* shows the pallet 100 of FIG. 7*a* without the electronic device 6*a* inserted in the device chamber 116 thereof. Clearly visible in FIG. 7*b* is the orifice 114 in the product supporting surface 108 of the platform 102. The interior of the device chamber 116 is also more clearly visible.

As mentioned in connection with FIG. 7*a*, the device chamber 116 fully receives an electronic device 6*a* therein. Put another way, the device chamber 116 defines, in isolation, the device enclosure. The device chamber 116 is generally cuboidal. That is to say, the device chamber 116 generally has the shape of a cuboid with one open end i.e. the orifice 114. The device chamber 16 comprises a plurality of alignment features 128*a-c* (further alignment features are not visible in FIG. 7*b*). The device chamber 116 comprises a cut-out 130 which is disposed in a base 132 of the device chamber 116.

From FIG. 7*b* it should be noted that the perimeter wall 118 extends beyond (specifically, below) the base 132 of the device chamber 116. For the purpose of this document, this is still considered to fall within the definition of the perimeter wall 118 surrounding the device chamber 116.

The way in which the electronic device 6*a* is snap fitted into the platform 102 is the same as for the previous embodiment.

FIG. 7*b* also indicates how the cut-out 126 in the perimeter wall 122 of the attachment portion 112 provides fluid communication across the perimeter wall 122. Specifically, the cut-out 126 is an aperture in the perimeter wall 122 and provides fluid communication between the atmosphere and the internal chamber 124*b* adjacent the cut-out 126. The cut-out 126 defines, in combination with the cut-outs 120 and 130 of the platform 102, the fluid pathway.

FIG. 7*c* is a perspective cutaway view of an underside of the pallet 100 of FIG. 7*a*. Electronic device 6*a* is shown received by the device chamber 116. FIG. 7*c* shows how the skid 104 further comprises a number of other cut-outs 134*a*, 134*b*.

The cut-outs 134*a*, 134*b* are disposed through a base 136 of the attachment portion 112 of the skid 104. In the base 136, the cut-outs 134*a*, 134*b* are in the form of apertures, or bores. These apertures 134*a*, 134*b* also provide drainage functionality in that any liquid present in the one or more internal chambers is able to pass through the apertures 134*a*, 134*b* to exit the skid 104. The apertures 134*a*, 134*b* therefore provide openings through which liquid can be evacuated. FIG. 7*c* also shows an underside of the base 132 of the device chamber 116. Also shown extending beyond the base 132 is perimeter wall 118 (at least a portion thereof) which comprises cut-out 120.

A feature not previously illustrated is that of an underside of the cut-out 130 (i.e. the drainage hole) in the base 132 of the device chamber 116. As shown in FIG. 7*c*, the cut-out 130 opens out into a boss 137 which guides liquid away from the device chamber 116, allowing it to exit the skid.

FIG. 8 is a close up perspective view of part of the skid 104 of FIGS. 7*a-c*. FIG. 8 primarily shows the attachment portion 112 from above.

As described in connection with the previous figures, the attachment portion 112 is defined, at least in part, by a perimeter wall 122. In use, the attachment portion 112 engages a corresponding attachment portion of a platform. As will be appreciated from FIG. 8, the perimeter wall 122 is not necessarily an outermost wall of the attachment portion 112. Instead, the attachment portion 112 may further comprise a ledge, lip or further extent of material which projects beyond the perimeter wall 122. In FIG. 8, such a lip is labelled 138. As will be appreciated from FIGS. 7*a* and 7*b*, it may be the lip 138 specifically which engages the attachment portion of the platform. Also as indicated in FIG. 7*b*, the perimeter wall 122 is not necessarily exposed once the pallet 100 is assembled. That is to say, in use, the perimeter wall 122 may be enclosed by one or more other components (such as, for example, a perimeter wall of an adjacent pallet component). Returning to FIG. 8, the perimeter wall 122 may define an outermost perimeter of at least a part of the attachment portion 112. In FIG. 8, the perimeter wall defines an outermost perimeter of an upper portion of the attachment portion 112 (i.e. that above the aforementioned lip 138).

Internal chambers surrounded by the perimeter wall 122 are visible in FIG. 8. In total, there are eight separate chambers distributed within the perimeter wall 122. It will also be appreciated that in the embodiment shown in FIG. 8 the perimeter wall 122 is formed of two C-shaped structures. As such, the perimeter wall 122 may not necessarily be a continuous wall but can instead be formed of a plurality of wall sections, like that shown in FIG. 8.

The base 136 of the attachment portion is also visible in FIG. 8. Furthermore, the base 136 is shown with cut-outs in the form of apertures 134*a-d* extending there through.

Perimeter wall 122 comprises cut-outs 126*a-d*. Cut-outs 126*a-d* provide fluid communication through, i.e. across, the perimeter wall 122 between the atmosphere and one of four adjacent internal chambers. Said four internal chambers surround a central aperture 140.

FIG. 9*a* is a perspective view of the electronic device 6*a*. The electronic device 6 can be said to comprise a body 63 and a cap 61.

As mentioned earlier in the document, references to the electronic device 6*a* may be to a combination of a chassis (i.e. the body 63 and the cap 61) and one or more electronic components housed therein.

The end face 62 is flat such that, when the electronic device 6*a* is inserted into the device chamber, the end face 62 is flush with the product supporting surface of the pallet. The end face 62 may be said to form part of the cap 61.

The cap 61 may, as suggested, close an otherwise open cavity defined by the body 63 of the device 6*a*. Alternatively, the cap 61 and body 63 may be integrally formed with one another.

Clips 58*a*, 58*b*, formed as part of the cap 61, are used to secure the electronic device 6*a* in position in the device chamber. The clips 58*a*, 58*b* are advantageously integrally formed with the cap 61. The clips 58*a*, 58*b* provide a snap-fit functionality which allows the electronic device 6*a* to be inserted without requiring tools.

In preferred arrangements, the electronic device 6*a* provides load sensing functionality. That is to say, the electronic device 6*a* may be able to sense a load placed upon the product supporting surface. The electronic device 6*a* may also be able to sample environmental signals, such as temperature and humidity.

FIG. 9*b* is a front view of the electronic device 6*a*.

The electronic device, including the cap, may be around 120 mm in height, around 85 mm wide and around 35 mm in depth. More specifically, the electronic device may have the following dimensions: 122 mm height by 86 mm width by 33 mm depth. The major width and depth dimensions may be defined by the cap of the electronic device. A portion of the electronic device extending from the cap may be around 120 mm in height by around 60 mm in width by around 25 mm in depth. More specifically, the portion may have dimensions 117 mm height by 62 mm width by 25 mm depth. The portion may refer to the body of the device.

The device chambers may be around 65 mm in width by around 25 mm in depth. More specifically, the device chambers may be around 63 mm wide by around 26 mm depth. This provides a small clearance around an outside of the portion of the electronic device which extends from the cap, in-situ. It will be appreciated that the orifices are have a larger cross-section to receive the cap. In this way, a substantially continuous product supporting surface is maintained across the cap.

The electronic device(s) in this document may be a combination of one or more electronic components disposed in a housing. The housing may be formed of a cap or lid, and a body portion extending therefrom.

FIG. 10*a* is a plan view of (some of) the portion of the skid 10*b* shown in FIG. 5. In FIG. 10*a*, a laterally projecting support portion (as shown in FIG. 5) is omitted. As such, FIG. 10*a* shows only a central "block" portion of the skid 10*b* (i.e. that bound by the perimeter wall 30).

FIG. 10*a* illustrates a further concept disclosed in the present application. The further concept is the use of a single aperture to serve, or communicate with, a number of different internal chambers. This is advantageous for a number of reasons but particularly when the aperture is used for drainage. The single aperture can provide drainage functionality for a number of internal chambers, reducing the number of apertures which need to be provided. Reducing the number of apertures is desirable because the presence of more apertures can reduce the robustness of the pallet component.

As mentioned, FIG. 10*a* is a plan view of a portion of the FIG. 5 arrangement. As such, many features shared in common with FIG. 5 will not be described in detail. However, for completeness, FIG. 10*a* illustrates the attachment portion 14*e*, perimeter wall 30 and device chambers 42*a*, 42*b*. Also illustrated are partition walls 43*a-f*, and device chamber walls 45*a*, 45*b*.

The plan view of FIG. 10*a* shows an arrangement of apertures provided in a surface 49 of the skid 10*b*. The surface 49 is an internal surface bound by the perimeter wall 30. The surface 49*b* can be said to oppose an outer surface of the skid 10*b* (i.e. that shown in FIG. 10*b*, and the surface upon which the skid 10*b* rests in use).

Returning to FIG. 10*a*, there are a number of apertures provided in the surface 49. Three apertures 51, 53 are disposed within each of the device chambers 42*a*, 42*b*. These apertures 51, 53 allow liquid within the device chambers 42*a*, 42*b* to drain out of the chambers and thus exit the component altogether.

The apertures of particular interest are labelled 55*a-d* in FIG. 10*a*. Each of the apertures 55*a-d* are intersected, or partially divided, by a respective partition wall. For example, the lower left-hand aperture 55*a* is intersected by a corresponding lower left-hand partition wall 43*b*. By virtue of the intersection, the apertures 55*a-d* each communicate with at least two internal chambers defined, at least in part, by respective partition walls 43*a*, 43*b*, 43*d*, 43*e*. The partition walls 43*a*, 43*b*, 43*d*, 43*e* which intersect respective apertures 55*d*, 55*a*, 55*b*, 55*c* are referred to as dividing walls, owing to these walls defining, at least in part, at least two adjacent internal chambers. For example, the lower left-hand partition wall, or dividing wall, 43*b* defines, at least in part, two adjacent internal chambers 57*a*, 57*b*.

Advantageously, by having each of the apertures 55*a-d* in communication with at least two different adjacent internal chambers, any liquid which enters the chambers can drain out of the pallet component via the common aperture. The number of apertures required for an array, or arrangement, of internal chambers is therefore lower than would otherwise be required.

Although not visible in FIG. 10*a*, FIG. 10*e* illustrates how the dividing wall 43*b* does not penetrate the aperture 55*a* in the illustrated arrangement. Instead, the dividing wall 43*b* is adjacent the aperture 55*a*, or lies out of the plane of the aperture 55*a*. However, in other arrangements, the dividing wall may penetrate the aperture.

Turning to FIG. 10*b*, a view from underneath the portion of the skid 10*b* of FIG. 13*a* is provided. FIG. 10*b* also shows outer surface 59, which opposes the surface 49. The outer surface 59 can be considered to form part of a support portion, owing to the outer surface 59 abutting an external surface upon which the skid 10*b* rests in use. The nature of the intersections of the apertures 55*a-d* by dividing walls 43*a*, 43*b*, 43*d*, 43*e* are also shown in FIG. 10*b*.

As shown in FIG. 10*b*, the apertures 51, 53, 55*a-d* are all hexagonal. Furthermore, intersected apertures 55*a-d* are larger in cross-section than the apertures 51, 53. However, it will be appreciated that a variety of aperture geometries, arrangements and relative sizes of apertures, and dividing walls, can otherwise be utilised.

FIGS. 10*c* and 10*d* are angled perspective views of the FIG. 10*a* arrangement. These Figures are included to show the arrangement of the dividing walls, with respect to the apertures, in three dimensions.

FIG. 10*e* is a magnified view of part of the underside of the arrangement shown in FIG. 10*b*, shown as an angled perspective view. FIG. 10*e* illustrates the aperture 55*a* being provided in the surface (not visible in FIG. 10*e*) and extending through to the opposing outer surface 59. The offset, or adjacent, nature of the dividing wall 43*b*, relative to the aperture 55*a*, is also demonstrated in FIG. 10*e*. That is to say, FIG. 10*a* shows that the dividing wall 43*b* does not penetrate the aperture 55*a*. Instead, the dividing wall 43*b* lies out of the plane of, or is disposed adjacent to, the aperture 55*a*.

FIG. 11 is an alternative illustration of the portion shown in FIG. 10*b*, with part of a laterally extending support portion 67 indicated schematically.

For the purposes of the following Figures, i.e. FIGS. 12 to 19, the numbering and naming of features equivalent to those illustrated and described in connection with FIGS. 1 to 11 will be restarted. That is to say, like features from the following Figures, which are also shown in the preceding Figures, may be identified using a different feature name and/or reference numeral.

FIG. 12 shows a pallet 10 according to one preferred embodiment of the invention, in a perspective plan view. The pallet 10 is made of plastic, more specifically has been produced from a thermoplastic in an injection-moulding method. However, comparable pallets could just as well be produced by other casting methods, for example in the rotational moulding method. The pallet 10 has in principle an upper deck 12 which forms the loading surface 14 of the pallet 10, and on the underside thereof a number of feet 16 (in this case nine). The feet 16 form access openings on all sides, by virtue of which the illustrated pallet 10 can be effortlessly handled by the known stacking and transporting devices (forklift trucks). In the illustrated example, the feet 16 are connected by skids, which gives the pallet 10 additional stability and makes it suitable for roller conveyors, automatic conveyor systems and high-bay warehouses.

The Pallet 10 has, as shown in FIG. 12, a flat surface on the upper deck 12, on the side faces and on the undersides of the skids 16. It is thus easy to load and to clean. Instead of corners, roundings are preferably provided, which are advantageous for transport purposes. Despite this outwardly smooth surface of the pallet 10, it is desirable to be able to incorporate a rib structure/ribbing 44 (see FIG. 13) in the pallet 10, since this leads to an increase in mechanical stability while at the same time saving weight. For the sake of better clarity, only a few ribs have been provided with the reference sign 44. To this end, the pallet 10 shown in FIG. 12 is of two-part design. More specifically, the upper deck 12 is injection-moulded as a kind of pallet main body and the skids/feet 16 are injection-moulded as a separate part or multiple separate parts and then are connected to the upper deck 12. In this way, the rib structure 44 can be formed on the sides of the upper deck 12 and of the skids 16 which are in each case located on the inner side in the assembled state of the pallet 10, while the outwardly facing surfaces are kept smooth/flat. From a manufacturing point of view, this has the advantage that the rib structure 44 can be created without forming undercuts, which hinder removal from the mould.

FIG. 13 shows the rib structure 44 on the (inwardly facing) underside of the upper deck 12. Advantageously, the upper deck 12 and the feet 16 of the pallet 10 have identical/complementary ribbings which, when the upper deck 12 and the feet 16 are connected, come to bear against one another, enable a transmission of force and ensure a high strength and bending stiffness of the pallet. The ribbing extends largely in a cross-shaped manner in the underside of the upper deck 12 shown in FIG. 13, but it could also be configured for example in a honeycomb shape. In the region of the feet 16, however, preference is given to a cross-shaped (orthogonal) arrangement of the ribs so as to define a receptacle for a built-in electronic component, as will be described in detail below.

For connecting the upper deck 12 to the feet/skids 16, in the illustrated exemplary embodiment a bolt connection is provided. To this end, each of the feet 16 of the pallet has a bolt receptacle 28. As can clearly be seen in FIGS. 3 and 4, the bolt receptacle 28 extends perpendicular to the upper deck 12 through the foot region of the upper deck and the foot 16 arranged on the underside thereof. By way of a thread 30 and a support shoulder 32, the upper deck 12 and the foot 16 are clamped to one another by a bolt 34. The bolt receptacle 28 is closed at the top by a bolt receptacle cover 36, which prevents dirt or liquid from accumulating in the bolt receptacle 28. As can clearly be seen in FIG. 15, centring aids/centring aid structures 38 are formed in the joining regions between the upper deck 12 and the feet 16. The design of the centring aids/centring aid structures 38 is such that the rib structure 44 of one joining part protrudes somewhat, while that of the other joining part is set back somewhat, so that the rib structure 44 of one joining part (here of the foot 16) penetrates into the other joining part and thus defines in a form-fitting manner the relative positioning of the two joining parts in the direction of extension of the loading surface 14.

The pallet 10 according to the invention has a receptacle 18 for a built-in electrical/electronic component (not shown), such as for example a transponder or a sensor units. More specifically, two such receptacles 18 are formed, which are each formed in the region of the central foot of the pallet 10. The receptacles 18 are recessed into the upper deck 12 in a pocket-like manner, that is to say are closed towards the underside of the pallet 10, and form a substantially cuboidal cavity, wherein the exact shape of the receptacle 18 can of course be varied, depending on the built-in part. The opening of the receptacles 18 on the loading surface side can be closed by a cover 20, as shown for example in FIG. 12. The cover 20 may be clipped or welded. In the illustrated example, the cover is clipped and to this end the upper deck has latching cutouts 40, which are shown in FIG. 14. An indentation 42 extending around the edge of the opening of the receptacle 18 makes it possible for the cover 20 to terminate flush with the loading surface of the upper deck 12 in the installed state.

Since the receptacle 18 is closed at the bottom and is closed on the loading surface side by the cover 20, this effectively prevents splashing water or other liquids from penetrating into the receptacle 18 from outside and compromising the function of any built-in components. In order to avoid any condensation of the air enclosed in the receptacle 18, apertures 22 which act as ventilation holes are formed in the vertical side walls of the receptacle 18. The apertures 22 additionally have the advantage that temperature differences from outside are more rapidly transmitted if a temperature sensor is inserted in the receptacle 18. The apertures/ventilation holes 22 extend in the horizontal direction (parallel to the loading surface) towards a chamber 24 adjacent to the receptacle 18 in the interior of the pallet 10, more specifically in the interior of the foot 16. The embodiment shown in the figures accordingly has two such adjacent chambers 24 (one per receptacle 18). The adjacent chambers 24 can advantageously be created by the construction of the rib structure 44. The adjacent chambers 24 each have two outlet holes 26 on the bottom side of the foot 16 in which they are arranged, said outlet holes being clearly visible in FIG. 17 or 19, for example.

FIGS. 18 and 19 show the upper deck-side half and the foot-side half of the central foot 16 in which the two receptacles 18 are integrated. The inner workings of the central foot 16 can thus be clearly described on the basis of these diagrams. It can be seen that many of the ribs 44 which come into contact with one another during the joining-together have cutouts 43 towards the joining zone/interface, so that all the cavities formed by the rib structure 44 can enter into gas exchange with one another. Additional ventilation holes 48, which are shown in FIG. 18, are provided in the outer wall 46 of the central foot in order to provide a further improved air circulation within the foot 16. In the illustrated example, the ventilation holes 48 are arranged in corner regions of the foot and open into corner chambers 45, which are connected via cutouts 43 to the chambers 24 adjacent to the receptacle 18.

The above-described construction avoids any penetration of splashing water through the apertures/ventilation holes 22, since the receptacles 18 are not directly connected to the surrounding environment. At the same time, however, an effective ventilation of the receptacle 18 is provided via the outlet openings 26 and the ventilation holes 48. To further improve the air circulation within the receptacle 18, spacers 27 are provided on the side walls and also on the bottom of the receptacle 18, which spacers prevent a built-in component inserted therein from bearing against one of the walls. As can be seen in FIGS. 18 and 19, for example, the spacers 27 are configured as ribs 27 which extend along the walls bounding the receptacle 18. As shown in FIG. 19, the spacers 27 can in turn have indentations 50 towards the built-in electronic component, so that no chamber formation occurs due to the spacers 27.

In the preferred embodiment shown, the apertures/ventilation holes 22 are formed at the interface between the upper deck 12 and the feet 16 fastened thereto. This enables an integral manufacture of the ventilation holes 22 during the injection moulding, without additional undercuts being created, even though the ventilation holes 22 extend transversely to the direction of removal from the mould. As can be seen for example in FIGS. 14 and 15, in the illustrated embodiment of the invention the ventilation holes 22 are configured as complementary semicircular cutouts on the rib edges of the upper deck 12 and of the feet 16 that come into contact with one another. A circular shape offers little impairment of mechanical stability, for example caused by notching, while providing a relatively large passage surface area.

By virtue of the above-described design of the foot 16 that houses the receptacle 18, any water that accumulates in the pallet foot 16 can run out and no condensation water forms due to the air circulation. Since the receptacle 18 has no direct access to the surrounding environment, but rather is connected thereto only indirectly via the interior of the foot 16, good protection is additionally provided against water penetrating from outside.

Rectangular plan dimensions of platforms (commonly known as pallets) including but not limited to those that conform to ISO 6780:2003(E) have lengths and widths of 1200×800 mm (commonly known as Euro size), 1200×1000 mm (commonly known as full size), and 1219×1016 mm.

Other standard sizes may be used in other regions of the world. The term "Half Pallet" is half of the size of the standard pallet according to the particular standard being used. Similarly, the term "Quarter Pallet" is a quarter of the size of the standard pallet according to the particular standard being used. For example, if the standard used in one region is 1200×800 mm, then a Half Pallet will have dimensions of 800×600 mm, and a Quarter Pallet will have dimensions of 600×400 mm. These standard dimensions are also applied to wheeled pallets commonly known as dollies, and also referred to as pallets on wheels or wheeled pallets.

Such pallets may be manufactured from plastic, or from some other material.

Throughout this document, an inward direction refers to a direction moving from a sidewall towards a central point of a product supporting surface (i.e. towards a centre of the product supporting surface, across the product supporting surface). Outward refers to a direction moving from the central point of the product supporting surface towards the sidewall (i.e. away from a centre of the product supporting surface, across the product supporting surface).

The described and illustrated embodiments are to be considered as illustrative and not restrictive in character, it being understood that only preferred embodiments have been shown and described and that all changes and modifications that come within the scope of the inventions as defined in the claims are desired to be protected.

In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

Optional and/or preferred features as set out herein may be used either individually or in combination with each other where appropriate and particularly in the combinations as set out in the accompanying claims. The optional and/or preferred features for each aspect of the invention, or concept, set out herein are also applicable to any other aspects of the invention, where appropriate.

Throughout this document, where Figures show the same or equivalent feature, but the numbering and/or naming of the feature differs between Figures, the language used to describe the feature is interchangeable.

The invention claimed is:

1. A pallet component comprising:

a support portion; and an attachment portion extending from the support portion and defined, at least in part, by a perimeter wall surrounding one or more internal chambers, the attachment portion configured to engage a corresponding attachment portion of another pallet component;

wherein the one or more internal chambers includes at least one device chamber configured to at least partially receive an electronic device inserted therein;

wherein one or more walls of the attachment portion, such as said perimeter wall, includes one or more cut-outs which are part of a fluid pathway between the at least one device chamber and atmosphere.

2. The pallet component according to claim 1, wherein the one or more internal chambers includes a plurality of internal chambers.

3. The pallet component according to claim 2, wherein the one or more cut-outs includes a plurality of cut-outs, and wherein the plurality of cut-outs are in direct fluid communication with different internal chambers of the plurality of internal chambers.

4. The pallet component according to claim 1, wherein the one or more internal chambers are distributed about a central aperture provided on the support portion of the pallet component.

5. The pallet component according to claim 1, wherein the one or more cut-outs define recesses in an end face of the perimeter wall, wherein the end face opposes the support portion.

6. The pallet component according to claim 1, wherein the pallet component is a platform, the support portion is a deck of the platform, the deck comprising a product support surface for supporting goods thereon; and the attachment portion is configured to abut a corresponding attachment portion of another pallet component, which other pallet component is a skid, when the skid and the platform are assembled together to form a pallet.

7. The pallet component according to claim 1, wherein the pallet component is a skid, the support portion is for supporting the skid on a surface, and the attachment portion is configured to abut a corresponding attachment portion of another pallet component, which other pallet component is a platform.

8. The pallet component according to claim 1, wherein the at least one device chamber includes one or more cut-outs in a wall, or a base, thereof.

9. The pallet component according to claim 8, wherein the at least one device chamber includes a plurality of cut-outs in a wall thereof.

10. The pallet component according to claim 1, wherein the perimeter wall includes a plurality of cut-outs, and the at least one device chamber is in fluid communication with at least two different perimeter wall cut-outs of the plurality of cut-outs.

11. The pallet component according to claim 10, wherein one or more intermediate cut-outs, disposed in a partition wall, interposes the one or more device chamber cut-outs and a most proximate one or more perimeter wall cut-outs.

12. The pallet component according to claim 11, wherein the one or more perimeter wall cut-outs, the one or more intermediate cut-outs, and the one or more device chamber cut-outs are part of an indirect fluid pathway.

13. The pallet component according to claim 1, wherein one or more supporting ribs project into the at least one device chamber, the one or more supporting ribs defining a ledge configured to limit an extent of insertion of the electronic device received in the at least one device chamber.

14. The pallet component according to claim 1, wherein the perimeter wall incorporates a chamfer along portions of the perimeter wall adjacent the at least one device chamber.

15. A pallet component assembly comprising:

an electronic device; and a pallet component comprising:

a support portion, and an attachment portion extending from the support portion and defined, at least in part, by a perimeter wall surrounding one or more internal chambers, the attachment portion abutting a corresponding attachment portion of another pallet component assembled to said pallet component to form said pallet component assembly, wherein the one or more internal chambers includes at least one device chamber configured to at least partially receive the electronic device inserted therein, wherein one or more walls of the attachment portion, such as said perimeter wall, includes one or more cut-outs which are part of a fluid pathway between the at least one device chamber and atmosphere.

16. A pallet comprising:

a platform comprising:

a deck comprising a product support surface for supporting goods thereon, and a deck attachment portion extending from the deck and defined, at least in part, by a deck perimeter wall surrounding one or more deck internal chambers, wherein the one or more deck internal chambers includes at least one deck device chamber configured to at least partially receive an electronic device inserted therein, and wherein one or more walls of the deck attachment portion, such as said deck perimeter wall, includes one or more cut-outs which are part of a fluid pathway between the at least one deck device chamber and atmosphere; and a skid comprising:

a support portion for supporting the skid on a surface, and a skid attachment portion extending from the skid and defined, at least in part, by a skid perimeter wall surrounding one or more internal skid chambers, wherein the one or more internal skid chambers includes at least one device skid chamber configured to at least partially receive the electronic device therein, and wherein one or more walls of the skid attachment portion, such as said skid perimeter wall, includes one or more cut-outs which define are part of a fluid pathway between the at least one skid device chamber and atmosphere;

wherein the respective attachment portions of the platform and the skid engage one another.

17. The pallet according to claim 16, wherein the one or more cut-outs of the platform and the skid define recesses in end faces of the respective perimeter walls of the attachment portions of the platform and the skid, with the one or more cut-outs in the respective perimeter walls aligning with one another to define one or more apertures.

18. A pallet comprising:

a platform comprising:

a deck comprising a product support surface for supporting goods thereon, and a deck attachment portion extending from the deck and defined, at least in part, by a deck perimeter wall surrounding one or more deck internal chambers; and a skid comprising:

a support portion for supporting the skid on a surface, and a skid attachment portion extending from the skid and defined, at least in part, by a skid perimeter wall surrounding one or more skid internal chambers, the skid attachment portion abutting the attachment portion of the platform, wherein the one or more skid internal chambers includes at least one skid device chamber configured to at least partially receive an electronic device inserted therein, and wherein the deck perimeter wall of the attachment portion includes one or more cut-outs which are part of a fluid pathway between the at least one skid device chamber and atmosphere.

19. The pallet according to claim 18, wherein the device chamber is defined by a plurality of walls and a base, and wherein the base comprises a cut-out which defines, at least in part, a fluid pathway between the device chamber and the atmosphere.

20. A pallet assembly comprising:

an electronic device configured to sense a load placed upon a product support surface; and a pallet comprising a deck comprising a product support surface for supporting goods thereon, whose weight is sensed by the electronic device when said goods are placed on said product support surface, the product support surface including an orifice which defines an open face of a device chamber, the device chamber configured to receive the electronic device therein and an end face of the electronic device is flush with the product support surface.

21. A pallet component comprising:

a surface in which an aperture is provided; and a plurality of walls which extend across the surface to define a plurality of internal chambers, wherein the plurality of walls comprise a dividing wall which defines, at least in part, at least two adjacent internal chambers of the plurality of internal chambers;

wherein the dividing wall intersects the aperture such that the at least two adjacent internal chambers are in communication with the aperture;

wherein the plurality of internal chambers comprise at least one device chamber configured to at least partially receive an electronic device inserted therein.

22. The pallet component according to claim 21, wherein the dividing wall extends into the aperture.

23. The pallet component according to claim 22, further comprising:

a second aperture provided in the surface; and a second plurality of walls which extend across the surface to define a second plurality of internal chambers, wherein the second plurality of walls comprises a second dividing wall which defines, at least in part, at least two adjacent internal chambers of the second plurality of internal chambers;

wherein the second dividing wall intersects the second aperture such that the at least two adjacent internal chambers, defined at least in part by the second dividing wall, are in communication with the second aperture.

* * * * *